US012650119B2

(12) United States Patent
Dalton et al.

(10) Patent No.: US 12,650,119 B2
(45) Date of Patent: Jun. 9, 2026

(54) PUMP DRIVE SYSTEM

(71) Applicant: Graco Minnesota Inc., Minneapolis, MN (US)

(72) Inventors: James M. Dalton, Maple Grove, MN (US); Thomas E. Pauly, Zimmerman, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 214 days.

(21) Appl. No.: 17/952,979

(22) Filed: Sep. 26, 2022

(65) Prior Publication Data

US 2023/0100781 A1 Mar. 30, 2023

Related U.S. Application Data

(60) Provisional application No. 63/250,007, filed on Sep. 29, 2021.

(51) Int. Cl.

| | |
|---|---|
| ***F04B 17/03*** | (2006.01) |
| ***F04B 9/02*** | (2006.01) |
| ***F04B 9/04*** | (2006.01) |
| ***F04B 15/02*** | (2006.01) |

(52) U.S. Cl.

CPC ..... *F04B 17/03* (2013.01); *F04B 9/02* (2013.01); *F04B 9/045* (2013.01); *F04B 15/02* (2013.01)

(58) Field of Classification Search

CPC .. F04B 9/045; F04B 9/02; F04B 15/02; F04B 17/03

See application file for complete search history.

(56) References Cited

U.S. PATENT DOCUMENTS

| | | | | |
|---|---|---|---|---|
| 3,501,180 A * | 3/1970 | Waara | F16C 11/04 | 403/77 |
| 4,194,414 A * | 3/1980 | Satoh | F16H 37/021 | 475/263 |
| 5,873,282 A * | 2/1999 | Dibbern, Jr. | H02K 7/081 | 74/421 A |
| 5,939,813 A * | 8/1999 | Schob | F04D 29/041 | 310/90 |

(Continued)

FOREIGN PATENT DOCUMENTS

| | | |
|---|---|---|
| DE | 590184 C | 12/1933 |
| DE | 202005020629 U1 | 5/2006 |

(Continued)

OTHER PUBLICATIONS

Extended European Search Report for EP Application No. 22198298.6, Dated Jan. 16, 2023, pp. 10.

(Continued)

*Primary Examiner* — Christopher S Bobish

(74) *Attorney, Agent, or Firm* — Kinney & Lange, P.A.

(57) ABSTRACT

A rotational output assembly is configured to provide power to a drive assembly to cause pumping by a pump. The rotational output assembly includes an electric motor and a pinion drive projecting axially from the motor. The pinion drive interfaces with bearings supported on a pump frame. The pinion drive includes a gear teeth section between portions interfacing with the bearings supported on the pump frame. The gear teeth section interfaces with a drive gear of the drive assembly to cause rotation of the drive gear.

19 Claims, 9 Drawing Sheets

(56) References Cited

U.S. PATENT DOCUMENTS

| | | | | |
|---|---|---|---|---|
| 6,752,067 | B1 * | 6/2004 | Davidson | F04B 53/20 417/415 |
| 7,350,334 | B2 * | 4/2008 | Smith | E05F 11/483 49/352 |
| 8,056,662 | B2 * | 11/2011 | Schoon | B60K 17/046 180/245 |
| 11,041,489 | B2 * | 6/2021 | Kirchhoff | H02K 7/088 |
| 11,078,895 | B2 * | 8/2021 | Eggebrecht | F04B 27/0404 |
| 2005/0244276 | A1 * | 11/2005 | Pfister | F04B 9/02 417/12 |
| 2015/0050169 | A1 * | 2/2015 | Horie | B08B 3/026 417/410.1 |
| 2016/0001624 | A1 * | 1/2016 | Meissner | F04B 27/04 280/124.16 |
| 2017/0149304 | A1 * | 5/2017 | Li | H02K 7/14 |

FOREIGN PATENT DOCUMENTS

| | | | |
|---|---|---|---|
| FR | 2929462 | A1 | 10/2009 |
| KR | 20050073127 | A | 7/2005 |
| WO | 2020047804 | A1 | 3/2020 |

OTHER PUBLICATIONS

First Communication Pursuant to Article 94(3) EPC for EP Application No. 22198298.6, Dated Oct. 15, 2024, pp. 4.

* cited by examiner

PUMP DRIVE SYSTEM

CROSS-REFERENCE TO RELATED APPLICATIONS

This application claims the benefit of U.S. Provisional Application No. 63/250,007 filed Sep. 29, 2021, and entitled "PUMP DRIVE SYSTEM," the disclosure of which is hereby incorporated by reference in its entirety.

BACKGROUND

The present disclosure relates generally to fluid displacement systems and, more particularly, to drive systems for reciprocating fluid displacement pumps.

Fluid displacement systems, such as fluid dispensing systems for paint, typically utilize positive displacement pumps such as axial displacement pumps to pull a fluid, such as paint, from a container and to drive the fluid downstream. The axial displacement pump is typically mounted to a drive housing and driven by a motor. A pump rod is attached to a reciprocating drive that drives reciprocation of the pump rod, thereby pulling fluid from a container into the pump and then driving the fluid downstream from the pump. In some cases, electric motors can power the pump.

SUMMARY

According to an aspect of the present disclosure, a fluid pumping assembly includes an electric motor having a stator and a rotor comprising a rotor housing and configured to rotate on a motor axis; a pinion cap formed separate from and attached to the rotor housing, the pinion cap comprising a gear teeth section; a drive gear that interfaces with the gear teeth section at a toothed interface; an eccentric that receives rotational motion from the drive gear; and a pump that receives reciprocating motion from the eccentric.

According to an additional or alternative aspect of the present disclosure, a fluid pumping assembly including an electric motor configured to generate a rotational output and having a stator and a rotor comprising a rotor housing and configured to rotate on a motor axis, the rotor including a first end wall, a second end wall, and a rotor body therebetween; a stud projecting from the first end wall, the stud projecting in a first axial direction along the motor axis and away from the stator; a pinion cap formed separate from and attached to the rotor, the pinion cap mounted on the stud, the pinion cap including a gear teeth section; a drive interfacing the pinion cap at a toothed interface to receive the rotational output from the electric motor via the pinion cap, the drive configured to convert the rotational output into reciprocating motion; and a pump that receives reciprocating motion from the drive.

According to another additional or alternative aspect of the present disclosure, a rotational output assembly configured to power pumping by a pump via a drive includes an electric motor having a stator and a rotor comprising a rotor housing and configured to rotate on a motor axis, the rotor including a first end wall, a second end wall, and a rotor body therebetween; a stud projecting from the first end wall, the stud projecting in a first axial direction along the motor axis and away from the stator; and a pinion cap formed separate from and attached to the rotor, the pinion cap mounted on the stud, the pinion cap including a gear teeth section between a first pinion end of the pinion cap and a second pinion end of the pinion cap, the second pinion end disposed between the gear teeth section and the rotor.

According to another additional or alternative aspect of the present disclosure, a fluid pumping assembly includes an electric motor having a stator and a rotor comprising a rotor housing and configured to rotate on a motor axis; a pinion drive extending axially from the rotor housing and including a first pinion end, a second pinion end, and a gear teeth section disposed between the first pinion end and the second pinion end; a first pinion bearing interfacing with the first pinion end; a second pinion bearing interfacing with the second pinion end; a drive gear that interfaces with the gear teeth section at a toothed interface; an eccentric that receives rotational motion from the drive gear; and a pump that receives reciprocating motion from the eccentric.

According to another additional or alternative aspect of the present disclosure, a fluid pumping assembly includes a pump frame; a motor supported by the pump frame and having a rotor and a stator, the rotor supported relative to the stator by at least one motor bearing disposed within the motor such that the rotor rotates on a motor axis; a pinion drive extending axially from a first end of the rotor, a drive gear interfacing with the pinion drive at a toothed interface between the drive gear and the pinion drive; and an eccentric connected to the drive gear to be rotated by the drive gear. The pinion drive includes a first pinion end interfacing with a first pinion bearing supported by the pump frame; a second pinion end interfacing with a second pinion bearing supported by the pump frame; and a gear teeth section disposed axially between the first pinion end and the second pinion end.

According to another additional or alternative aspect of the present disclosure, a fluid pumping assembly including a pump frame at least partially defining a gear chamber; a drive gear supported by the pump frame; an eccentric that receives rotational motion from the drive gear; a first pinion bearing captured by the pump frame; a second pinion bearing captured by the pump frame; and a rotational output assembly including an electric motor and a pinion drive. The electric motor includes a stator and a rotor comprising a rotor housing and configured to rotate on a motor axis. The pinion drive extends axially from the rotor housing and including a first pinion end, a second pinion end, and a gear teeth section disposed between the first pinion end and the second pinion end, the gear teeth section configured to interface with the drive gear at the toothed interface disposed at least partially within the gear chamber. The rotational output assembly mountable to the pump frame by movement of the rotational output assembly in a first axial direction along the motor axis, and the rotational output assembly dismountable from the pump frame by movement of the rotational output assembly in a second axial direction opposite the first axial direction.

According to another additional or alternative aspect of the present disclosure, a modular pumping assembly including a pump frame configured to support a displacement pump; a first pinion bearing captured by the pump frame; a second pinion bearing aligned with the first pinion bearing on a pinion support axis, the second pinion bearing captured by the pump frame; and first rotational output assembly. The first rotational output assembly includes a first electric motor and a first pinion drive. The first electric motor includes a first stator; and a first rotor comprising a first rotor housing and configured to rotate on a first motor axis. The first pinion drive extends axially from the first rotor housing and including a first pinion end, a second pinion end, and a first gear teeth section disposed between the first pinion end and the second pinion end, the first gear teeth section configured to output rotational motion from the first rotor at a first toothed interface. The first rotational output assembly mountable to the pump frame by movement of the first rotational output assembly in a first axial direction along the pinion support axis with the first motor axis disposed coaxial with the pinion support axis.

The first rotational output assembly dismountable from the pump frame by movement of the first rotational output assembly in a second axial direction opposite the first axial direction.

According to another additional or alternative aspect of the present disclosure, a method of mounting a rotational output generator to a pumping assembly includes aligning a rotational output assembly with a pump frame such that a rotational axis of the motor is aligned coaxially with a pinion bearing axis through the pump frame; and shifting the rotational output assembly axially relative to the pinion axis and in a first axial direction to form a dynamic mechanical connection between the rotational output assembly and the pump frame, the rotational output assembly configured to power pumping by a pump supported by the pump frame.

DETAILED DESCRIPTION

The present disclosure is directed to a drive system for a reciprocating fluid displacement pump. The drive system of the present disclosure has an electric motor with an eccentric driver. A drive converts rotational output of the rotor to linear, reciprocating input to the fluid displacement member. The rotor can be disposed outside of the stator to rotate about the stator such that the motor is an outer rotator motor. The rotor includes a pinion drive that projects axially from the motor. The pinion drive interfaces with a gear of the drive to provide rotational input to the drive.

Figure 1B:
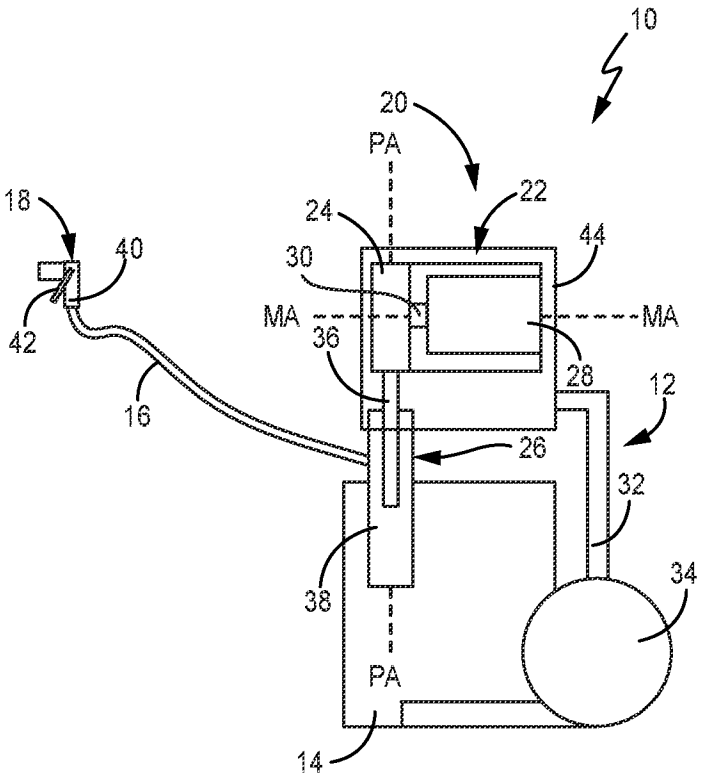
FIG. 1B is a side elevational schematic block diagram of the spray system of FIG. 1A.
Figure 1A:
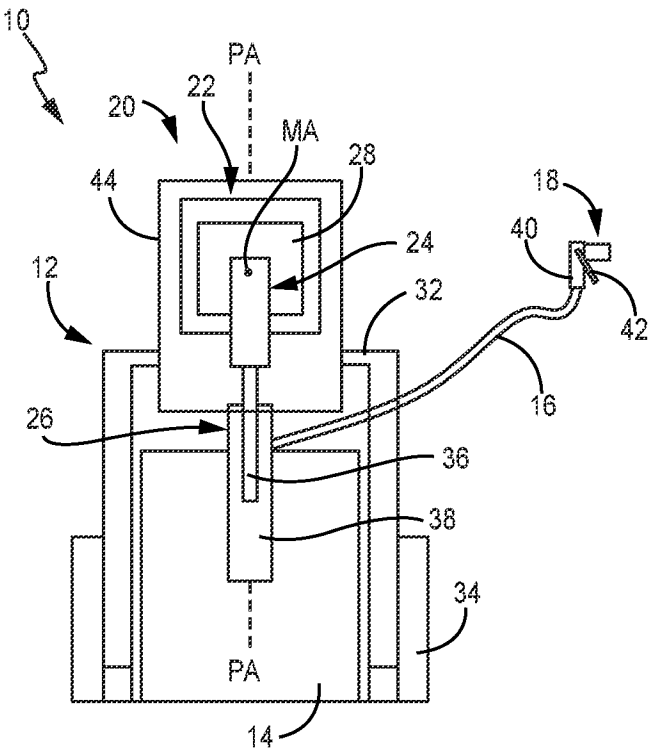
FIG. 1A is a front elevational schematic block diagram of a spray system.

FIG. 1A is a front elevational schematic block diagram of spray system 10. FIG. 1B is a side elevational schematic block diagram of spray system 10. FIGS. 1A and 1B are discussed together. Support 12, reservoir 14, supply line 16, spray gun 18, and fluid displacement assembly 20 are shown. Fluid displacement assembly 20 includes rotational output assembly 22, drive assembly 24, and displacement pump 26. Rotational output assembly 22 includes motor 28 and pinion drive 30. Support 12 includes system frame 32 and wheels 34. Fluid displacer 36 and pump body 38 of displacement pump 26 are shown. Spray gun 18 includes handle 40 and trigger 42.

Spray system 10 is a system for applying sprays of various fluids, examples of which include paint, water, oil, stains, finishes, aggregate, coatings, and solvents, amongst other options, onto a substrate. Fluid displacement assembly 20, which can also be referred to as a pump assembly, can generate high fluid pumping pressures, such as about 3.4-69 megapascal (MPa) (about 500-10,000 pounds per square inch (psi)) or even higher. In some examples, the pumping pressures are in the range of about 20.7-34.5 MPa (about 3,000-5,000 psi). High fluid pumping pressure is useful for atomizing the fluid into a spray for applying the fluid to a surface.

Fluid displacement assembly 20 is configured to draw spray fluid from reservoir 14, increase the pressure of the spray fluid, and pump the spray fluid downstream to spray gun 5 for application on the substrate. Support 12 is connected to fluid displacement assembly 20 and supports fluid displacement assembly 20 relative to reservoir 14. Support 12 can receive and react loads from fluid displacement assembly 20 during pumping. For example, system frame 32 can be connected to rotational output assembly 22 to react the loads generated during pumping. Pump frame 44 forms a portion of the system frame 32 that is connected to and supports rotational output assembly 22. In some examples, system frame 32 is formed separate from and connected to pump frame 44, such as by bolts, welding, etc. Wheels 34 are connected to system frame 32 to facilitate movement of fluid displacement assembly 20 between job sites and within a job site.

Pump frame 44 supports other components of fluid displacement assembly 20. Rotational output assembly 22 and displacement pump 26 are supported by pump frame 44. In some examples, rotational output assembly 22 and displacement pump 26 are connected to pump frame 44. For example, the rotational output assembly 22 can be mounted to the pump frame 44 by a dynamic interface and a static interface. Pump frame 44 supports the rotational output assembly 22 at the dynamic interface such that loads can be transmitted through the dynamic interface (e.g., from rotational output assembly 22 to pump frame 44). The dynamic interface supports the rotational output assembly 22 while allowing rotating components of rotational output assembly 22 to rotate relative to the pump frame 44. The dynamic interface can be formed between pump frame 44 and pinion drive 30. The static interface is formed such that loads can be transmitted through the static interface. The static interface supports the rotational output assembly 22 such that a non-moving component of rotational output assembly 22 interfaces with pump frame 44 at the static interface. The static interface can be formed between support 12 and motor 28.

Pinion drive 30 is connected to the motor 28 to be rotated by the motor 28. Motor 28 is an electric motor having a stator and a rotor. Motor 28 can be configured to be powered by any desired power type, such as direct current (DC), alternating current (AC), and/or a combination of direct current and alternating current. The rotor is configured to rotate about a motor axis MA in response to current, such as direct current or alternating current signals, through the stator. In some examples, the rotor can rotate about the stator such that motor 28 is an outer rotator motor. In some examples, the rotor can rotate within the stator such that motor 28 is an inner rotator motor.

Pinion drive 30 is connected to the motor 28 to be rotated by the rotor. In some examples, pinion drive 30 is formed separate from and connected to the rotor. As discussed in more detail below, pinion drive 30 can be formed as a pinion cap that is separate from the rotor and connected to the rotor. Pinion drive 30 does not extend through motor 28 or overlap with the stator along the motor axis MA. Instead, pinion drive 30 extends from the rotor and away from the stator. Pinion drive 30 is not overhung. Instead, pinion drive 30 is supported by multiple bearings, such as a first bearing on a first side of a gear teeth section of pinion drive 30 and a second bearing on a second side of the gear teeth section of pinion drive 30. The second bearing can be disposed between the gear teeth of pinion drive 30 and the rotor along motor axis MA. Pinion drive 30 is disposed coaxially with motor 28 such that pinion drive 30 rotates on motor axis MA coaxial with rotor.

Drive assembly 24 is connected to motor 28 to be powered by motor 28. In the example shown, drive assembly 24 is connected to pinion drive 30 to receive the rotational output from the motor 28 by pinion drive 30. Drive assembly 24 receives a rotational output from motor 28 and converts that rotational output into a linear input along pump axis PA. For example, drive assembly 24 can be formed by an eccentric crank that is rotatably driven by motor 28 through pinion drive 30. Drive assembly 24 can be connected to pump frame 44 to be supported by the pump frame 44.

Drive assembly 24 is connected to fluid displacer 36 to drive reciprocation of fluid displacer 36 along pump axis PA. As illustrated in FIG. 1B, motor axis MA is disposed transverse to pump axis PA. More specifically, motor axis MA can be orthogonal to pump axis PA. In other embodiments, motor 28 and fluid displacer 36 can be oriented in the same axial direction such that motor axis MA and pump axis PA are disposed parallel. Depending on the number of gear stages and connection with pinion drive 30, some examples can include motor axis MA and pump axis PA that are coaxial.

Fluid displacer 36 is configured to reciprocate within a pump body 38 to pump the spray fluid. For example, the fluid displacer 36 can be formed as a piston that reciprocates within a cylinder of the pump body 38. In some examples, the pump 26 is configured as a double displacement pump that outputs spray fluid during both a first stroke as fluid displacer 36 moves in a first axial direction along pump axis PA and a second stroke as fluid displacer 36 moves in a second, opposite axial direction along pump axis PA. Fluid displacer 36 reciprocates along pump axis PA to pump spray fluid from reservoir 14 to spray gun 18.

During operation, the user can maneuver fluid displacement assembly 20 to a desired position relative the target substrate by moving support 12. For example, the user can maneuver fluid displacement assembly 20 by tilting system frame 32 on wheels 34 and rolling fluid displacement assembly 20 to a desired location. In some examples, a handle can extend from fluid displacement assembly 20 and the user can maneuver fluid displacement assembly 20 within a job site or between job sites by grasping the handle and carrying fluid displacement assembly 20. Displacement pump 26 is fluidly connected to reservoir 14, such as by an intake line extending from pump 26 or by pump 26 extending into the spray fluid within reservoir 14. Motor 28 provides the rotational input to drive assembly 24 by pinion drive 30. Drive assembly 24 converts the rotating motion to linear motion and provides linear input to fluid displacer 36 to cause reciprocation of fluid displacer 36. Fluid displacer 36 draws the spray fluid from reservoir 14, pressurizes the spray fluid, and drives the spray fluid downstream through supply line 16 to spray gun 18.

The user can manipulate spray gun 18 by grasping the handle 40 of the spray gun 18, such as with a single hand of the user. The user causes spraying by actuating trigger 42. For example, actuating trigger 42 can cause a valve disposed within the body of the spray gun 18 to shift to an open state to open a flowpath for release of the pressurized fluid as a spray from spray gun 18. In some examples, the pressure generated by fluid displacement assembly 20 is sufficient to atomize the spray fluid exiting spray gun 18 to generate the fluid spray. In some examples, spray gun 18 is an airless spray gun that does not include a flow of air to facilitate pressurization of the fluid or shaping of the resultant spray pattern.

In some examples, rotational output assembly 22 is removably mountable to the pump frame 44. For example, a first rotational output assembly 22, including a first motor 28 and pinion drive 30, can be removed by first axial movement along the motor axis MA, then a second rotational output assembly, including a second motor 28 and pinion drive 30, can be mounted by second axial movement along the motor axis MA opposite the first axial movement. The first motor can be the same configuration as or different from the second motor. The first pinion drive can be the same configuration as or different from the second pinion drive.

Figure 2:
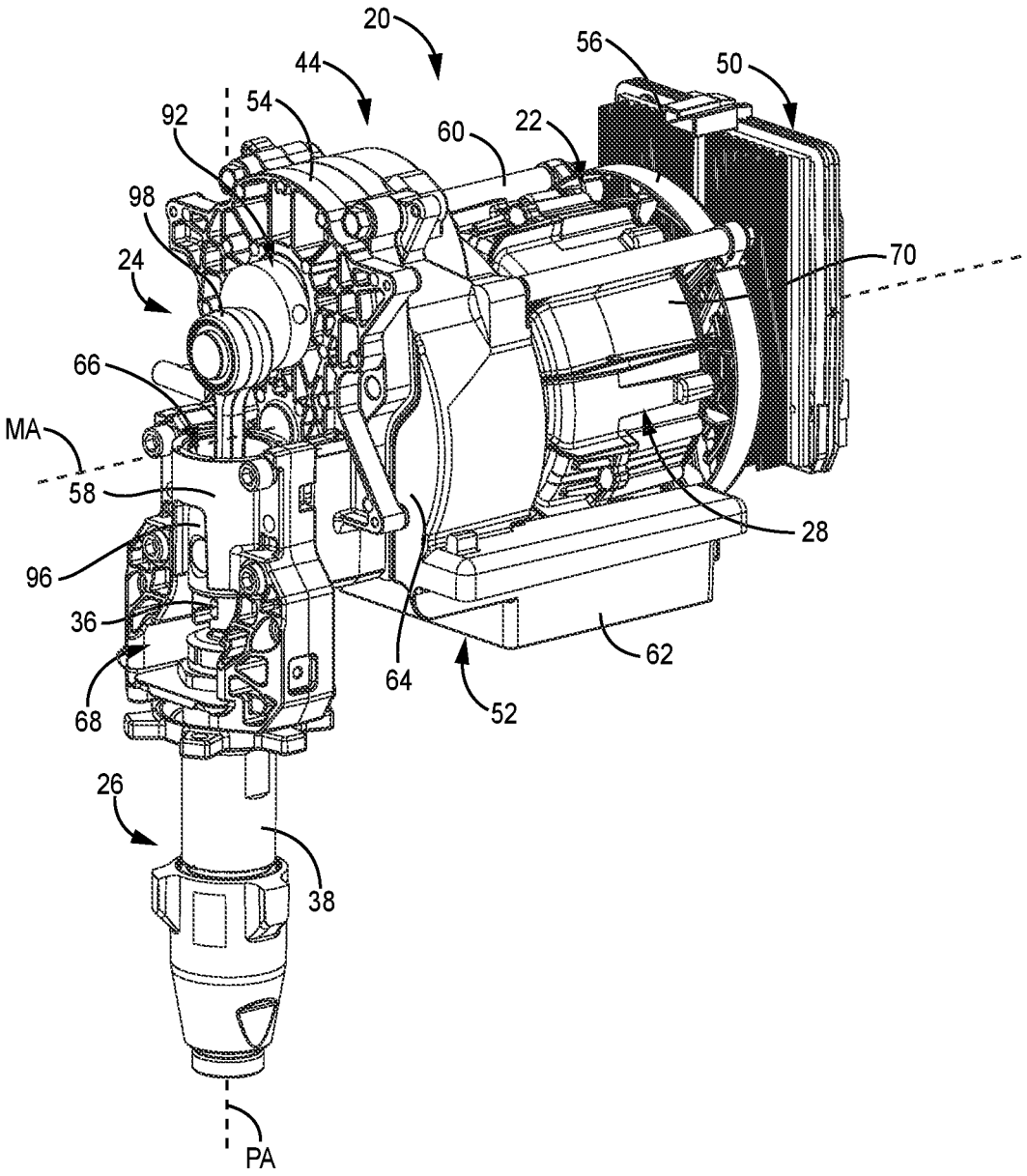
FIG. 2 is an isometric front side view of a fluid displacement assembly.
Figure 3:
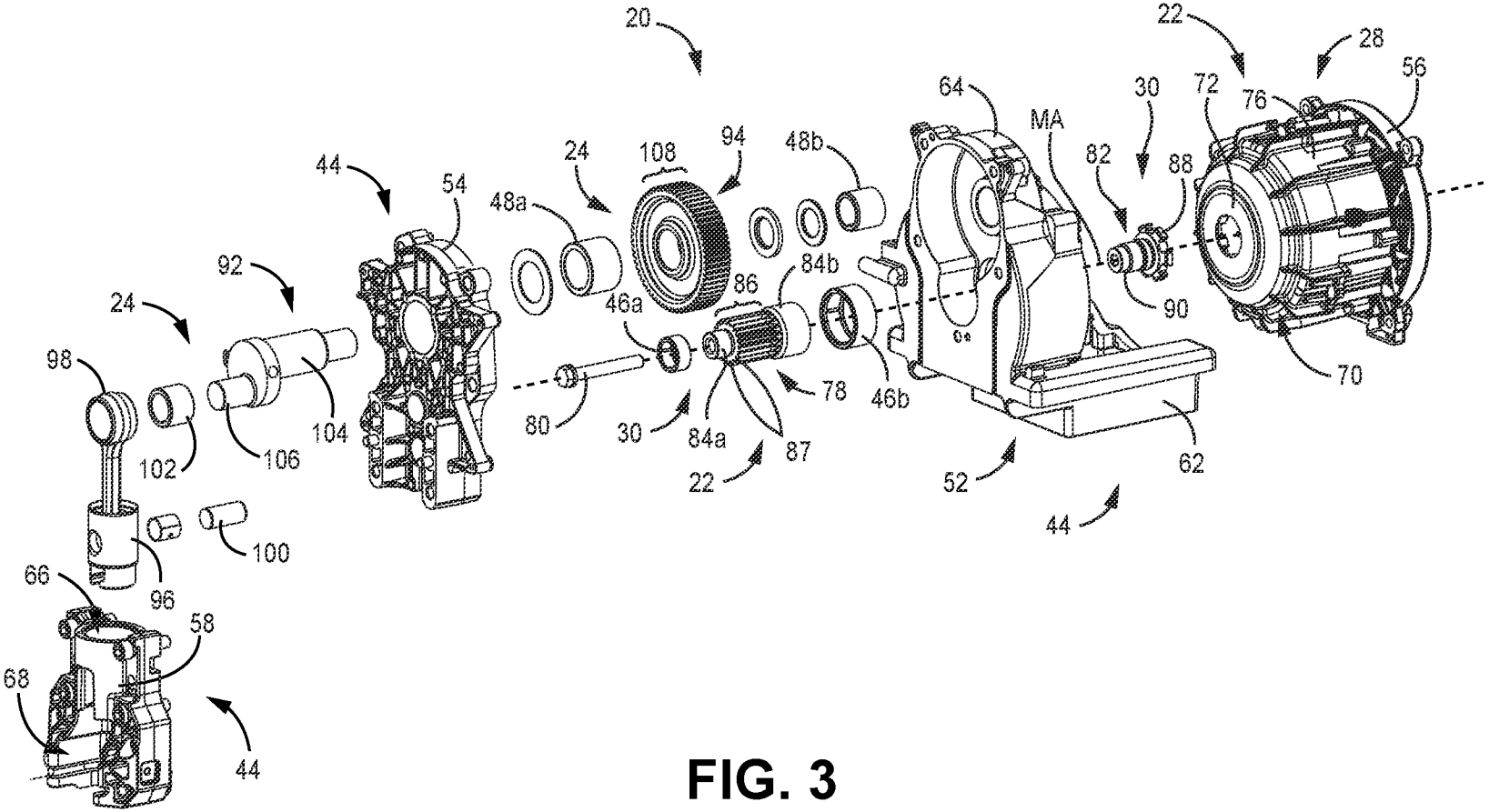
FIG. 3 is an isometric exploded view showing portions of the fluid displacement assembly shown in FIG. 2.

FIG. 2 is an isometric view of fluid displacement assembly 20. FIG. 3 is an exploded view of fluid displacement assembly 20. FIGS. 2 and 3 will be discussed together. Rotational output assembly 22, drive assembly 24, pump 26, pump frame 44, pinion bearings 46*a*, 46*b*, drive bearings 48*a*, 48*b*, and control panel 50 of fluid displacement assembly 20 are shown. Pump frame 44 includes support frame 52, retainer plate 54, brace plate 56, drive housing 58, and connectors 60. Support frame 52 includes base plate 62 and mount plate 64. Drive housing 58 includes drive link opening 66 and pump opening 68.

Motor 28 and pinion drive 30 of rotational output assembly 22 are shown. Rotor 70 of motor 28 is shown. First end wall 72 and rotor body 76 of rotor 70 are shown. Pinion drive 30 includes pinion cap 78, fastener 80, and stud 82. Pinion end 84*a*, pinion end 84*b*, and gear teeth section 86 of pinion drive 30 are also shown. Stud 82 includes spline 88 and post 90. Eccentric 92, drive gear 94, drive link 96, follower 98, drive pin 100, and follower bearing 102 of drive assembly 24 are shown. Eccentric 92 includes eccentric shaft 104 and eccentric driver 106. Pump body 38 and fluid displacer 36 of pump 26 are shown.

Of particular note concerning the examples discussed in herein is that the pinion drive 30 replaces a conventional pinion. An outer rotor cannot use a conventional pinion. In conventional drive motors, a rotor rotates within the stator, instead of the rotor 70 rotating radially around a stator as shown. Moreover, in the conventional drive motors, a pinion shaft extends through the motor, including the rotor, such that the pinion shaft overlaps radially with the electromagnetics of the motor. In the present examples, no shaft extends entirely axially through the motor 28, whether part of the pinion or not. In the example shown, first end wall 72 of rotor 70 is closed such that no component extends fully through the first end wall 72. In this case, a pinion drive is mounted onto an outer rotor, the pinion drive 30 including the gear teeth section 86 having teeth for interfacing with the teeth of the drive gear 94. The pinion drive 30 does not extend through the motor 28. Rather, the pinion drive 30 is only connected with an outer housing of the rotor 70. The pinion drive 30 is supported by dual pinion bearings 46*a*, 46*b* on opposite ends of the pinion drive 30, with a third section (e.g., the gear teeth section 86 in the example shown)

being between the between pinion ends 84*a,* 84*b* supported by the pinion bearings 46*a,* 46*b.*

Components can be considered to radially overlap when the components are disposed at a common position along an axis (e.g., along the motor axis MA) such that a radial line projecting that axis extends through each of those radially-overlapped components. Components can be considered to axially overlap when the components are disposed at common positions spaced radially from the axis (e.g., relative to motor axis MA) such that an axial line coaxial with or parallel to the axis extends through each of those axially-overlapped components.

Motor 28 is an electric motor such that rotation of rotor 70 is caused by electric power provided to the stator. Motor 28 can be formed as a reversible motor in that rotor 70 can be rotatably driven in either of two rotational directions about the motor axis MA (clockwise or counterclockwise). In the example shown, rotor 70 is formed as a housing having a first end wall 72 and a second end wall 74 at opposite axial ends of the rotor housing.

Rotor 70 includes a rotor body 76 that extends axially between the first end wall 72 and the second end wall 74. Rotor body 76 is cylindrical in the example shown. First and second end walls 72, 74 extend substantially radially inward from rotor body 76 and towards motor axis MA. Rotor body 76 and/or first end wall 72 and/or second end wall 74 can have fins that extend outward to increase a surface area of rotor 70 to facilitate cooling of motor 28. First end wall 72 and rotor body 76 are formed as a single casting in the example shown. It is understood, however, that first end wall 72 can be connected to rotor body 76 in any desired manner, such as by welding, fasteners, press-fitting, etc. In the example shown, motor 28 is formed such that rotor 70 rotates about a stator, as shown in more detail in FIGS. 4A and 4B. The motor 28 shown is formed as an outer rotator. It is understood, however, that other examples of motor 28 are formed as an inner rotator, in which the rotor is disposed radially within the stator.

Pinion drive 30 is disposed at a first end of rotational output assembly 22. The first end of rotational output assembly 22 is the output end at which the rotational output is provided to other components supported by pump frame 44. In the example shown, pump frame 44 is connected to a second end of rotational output assembly 22, the second end is opposite the first end along the motor axis MA. Pinion drive 30 is disposed at an axially opposite end of motor 28 from brace plate 56 of pump frame 44. Pinion drive 30 is mounted to rotor 70 to rotate in a 1:1 relationship with the rotor 70. In the example shown, pinion cap 78 is mounted to stud 82 to form pinion drive 30. Stud 82 is connected to rotor 70. In the example shown, stud 82 is mounted to first end wall 72 of rotor 70. Spline 88 of stud 82 interfaces with rotor 70 such that rotor 70 transmits torque to stud 82 through the splined interface between stud 82 and rotor 70. Post 90 projects axially outward from spline 88 and away from rotor 70 along the motor axis MA.

Rotational output assembly 22 is configured as a high torque, low speed assembly. In some examples, rotational output assembly 22 is configured to generate torque up to about 160 newton-meters (Nm) and provide rotational outputs at speeds up to about 1200 revolutions per minute (rpm). In some examples, rotational output assembly 22 is configured to generate torque up to about 80 newton-meters (Nm) and provide rotational outputs at speeds up to about 600 revolutions per minute (rpm). In the example shown, stud 82 is connected to rotor 70 by rotor 70 being cast over the spline 88 of stud 82. For example, rotor 70 can be formed from a lighter-weight material, such as a metal, such as aluminum, while stud 82 can be formed from a heavier, more durable material, such as a metal, such as steel. The splined interface provides sufficient surface area between the first material forming rotor 70 and the second material forming stud 82 to facilitate rotor 70 transmitting torque without experiencing excessive loading. Stud 82 is formed from the more durable metal to facilitate stud 82 transmitting torque to pinion cap 78 by one or more interfaces having smaller interface contact surface area than the interface between stud 82 and rotor 70 when taken in a plane normal to the motor axis MA. For example, pinion cap 78 can be secured to stud 82 by one or more threaded interfaces. The material forming stud 82 is able to handle the loads generated at those interfaces. Post 90 extends axially outward from spline 88 away from rotor 70. Post 90 is not overcast by the material forming rotor 70. The durable material forming stud 82 is exposed along post 90 prior to pinion cap 78 being mounted on post 90. Post 90 is not enclosed within rotor 70.

Pinion cap 78 is connected to rotor 70 to be rotated by rotor 70. In the example shown, pinion cap 78 is indirectly connected to rotor 70 by stud 82 that connects pinion cap 78 to rotor 70. Pinion cap 78 is connected to stud 82 at post 90. In the example shown, pinion cap 78 is directly connected to stud 82 by the interface between pinion cap 78 and stud 82 and indirectly connected to stud 82 by the interface between fastener 80 and stud 82. In the example shown, pinion cap 78 is directly connected to stud 82 by a threaded interface between pinion cap 78 and post 90. Specifically, pinion cap 78 includes a bore formed in second pinion end 84*b.* The bore in the pinion cap 78 includes internal threading that connects to external threading on post 90. As such, pinion drive 30 can be connected to stud 82 by interfaced threading.

Fastener 80 further connects pinion cap 78 to stud 82. Fastener 80 can be a bolt, among other options. Fastener 80 extends fully through pinion cap 78, through first pinion end 84*a,* the gear teeth section 86 of pinion cap 78, and second pinion end 84*b,* to connect pinion cap 78 to stud 82. The fastener 80 includes external threads that interface with internal threads formed in a stud bore extending into post 90. As such, pinion cap 78 is connected to stud 82 by a dual threaded interface in the example shown. The connection between pinion cap 78 and stud 82 is configured to prevent loosening of pinion cap 78 from rotor 70. For example, the threaded interface between pinion cap 78 and stud 82 can be formed in a first configuration (e.g., one of a left-hand and right-hand thread) and the threaded interface between fastener 80 and stud 82 can be formed in a second configuration (e.g., the other one of a left-hand and right-hand thread). Having threading in both directions ensures that the connection between the stud 82 and the pinion cap 78 is maintained even if the motor 28 reverses its direction of rotation.

Pinion drive 30 includes gear teeth section 86 that forms a toothed section of pinion drive 30. The pinion teeth 87 forming gear teeth section 86 are axially elongate relative to the motor axis MA. Each tooth can extend parallel to the motor axis MA. The gear teeth section 86 interfaces with the drive teeth section 108 of drive gear 94 such that pinion drive 30 can drive rotation of drive gear 94 by that toothed interface. The rotational output assembly 22 powers pumping by pump 26 through the toothed interface. The teeth 87 of pinion drive 30 that form the gear teeth section 86 are formed between first pinion end 84*a* and second pinion end 84*b.* As shown, the pinion drive 30 includes a first pinion end 84*a* that is covered by pinion bearing 46*a* and a second pinion end 84*b* that is covered by pinion bearing 46*b*, and a gear teeth section 86 axially between the first pinion end 84*a* and the second pinion end 84*b*. In the example shown, first pinion end 84*a*, second pinion end 84*b*, and gear teeth section 86 are each formed on the pinion cap 78.

The gear teeth section 86 interfaces with drive teeth section 108 of drive gear 94. First pinion end 84*a* interfaces with pinion bearing 46*a* to rotationally support pinion drive 30. Second pinion end 84*b* interfaces with pinion bearing 46*b* to rotationally support pinion drive 30. As such, the gear teeth section 86 of pinion drive 30 is disposed axially between pinion bearings 46*a*, 46*b* with rotational output assembly 22 mounted to pump frame 44. Pinion bearing 46*a* is supported by retainer plate 54. Pinion bearing 46*b* is supported by support frame 52. Specifically, pinion bearing 46*b* is supported by mount plate 64 of support frame 52.

In the example shown, pinion bearing 46*a* is smaller than pinion bearing 46*b*. The relative sizing of pinion bearing 46*a* and pinion bearing 46*b* facilitates spray system 10 forming a modular spray system that allows for removal and replacement of rotational output assembly 22 without removing other components of fluid displacement assembly 20, as discussed in more detail below. In the example shown, pinion drive 30 is disposed coaxially with rotor 70 on motor axis MA such that pinion drive 30 rotates on a rotational axis that is coaxial with a rotational axis of rotor 70.

Rotational output assembly 22 is supported on the pump frame 44. Specifically, pinion drive 30 is rotationally coupled to pump frame 44 by pinion bearings 46*a*, 46*b* and motor 28 is coupled to pump frame 44 at a static interface. Pinion bearings 46*a*, 46*b* mechanically connect rotor 70 to pump frame 44, via pinion drive 30. In the example shown, pinion bearings 46*a*, 46*b* mechanically connect rotational output assembly 22 to both retainer plate 54 and support frame 52. Pinion bearings 46*a*, 46*b* support loads from both rotor 70 and pinion drive 30.

Control panel 50 is disposed on an opposite axial side of rotor 70 from pinion drive 30 along the rotational axis MA of rotor 70. Control panel 50 is mounted at the second end of rotational output assembly 22. Control panel 50 can include and/or support a controller and various other control and/or electrical elements of spray system 10. The controller is operably connected to the motor 28, electrically and/or communicatively, to control operation of motor 28 thereby controlling pumping by displacement pump 26. The controller can be of any desired configuration for controlling pumping by displacement pump 26 and can include control circuitry and memory. The controller is configured to store software, store executable code, implement functionality, and/or process instructions.

Figure 4A:
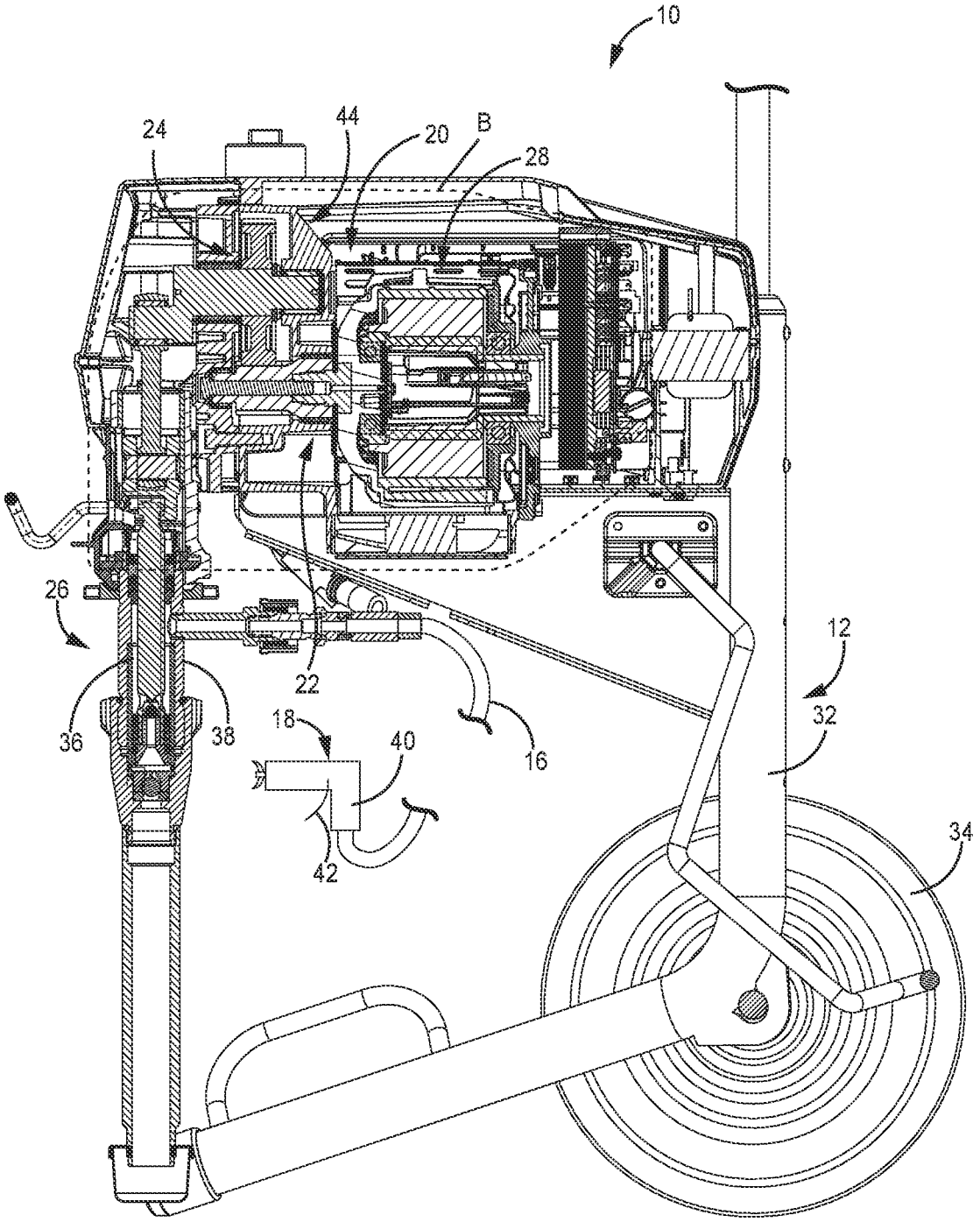
FIG. 4A is a cross-sectional view of a spray system.
Figure 4B:
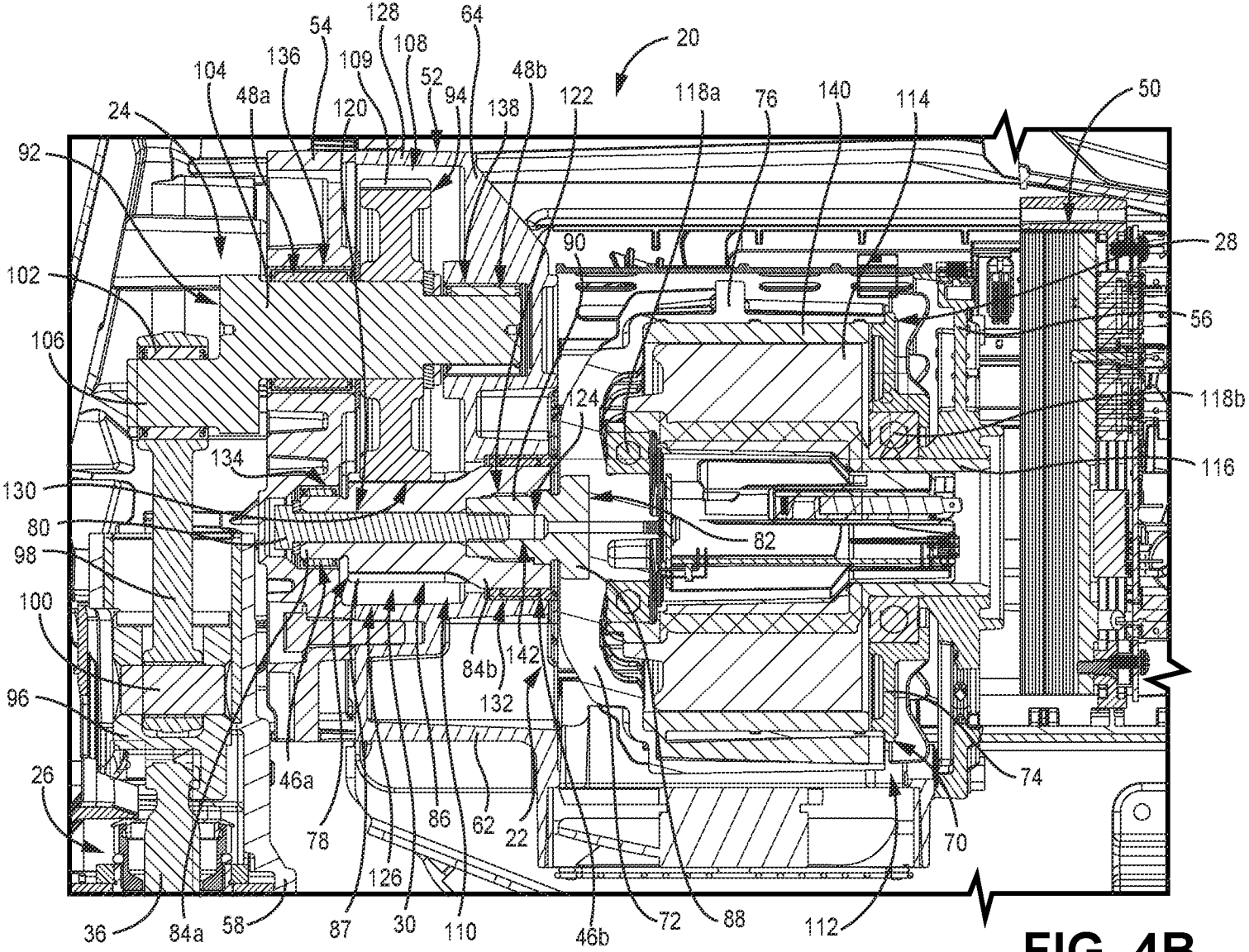
FIG. 4B is an enlarged view of detail B in FIG. 4A.

Pump frame 44 supports other components of fluid displacement assembly 20. Pump frame 44 supports pump 26, drive assembly 24, and rotational output assembly 22. Pump frame 44 reacts forces generated during rotation by components of rotational output assembly 22 and generated by reciprocation and driving of the spray fluid by fluid displacer 36. Pump frame 44 is mechanically coupled to rotational output assembly 22 at a dynamic interface and a static interface. In the example shown, pump frame 44 interfaces with pinion drive 30 at the dynamic interface. Specifically, pump frame 44 interfaces with pinion drive 30 by pinion bearings 46*a*, 46*b*. Pump frame 44 interfaces with motor 28 at the static interface, as best seen in FIGS. 4A and 4B.

In the example shown, support frame 52 is mechanically coupled to rotational output assembly 22 at a dynamic interface by pinion bearings 46*a*, 46*b* interfacing with pinion drive 30. Base plate 62 of support frame 52 extends horizontally from mount plate 64 and below rotor 70. Base plate 62 extends to radially overlap with rotor 70. Mount plate 64 extends away from base plate 62. Mount plate 64 can be considered to extend vertically from base plate 62. Motor 28 is connected to pump frame 44 such that motor 28 is supported above base plate 62 of support frame 52. In the example shown, mount plate 64 projects from base plate 62 and is formed integrally with base plate 62 such that mount plate 64 and base plate 62 form a unitary support component.

Brace plate 56 is disposed on an opposite axial side of motor 28 from mount plate 64 along motor axis MA. Brace plate 56 is connected to motor 28 to support motor 28. The static interface between pump frame 44 and rotational output assembly 22 can be formed between brace plate 56 and motor 28. Brace plate 56 can be connected to support frame 52, such as by fasteners connecting brace plate 56 to base plate 62 of support frame 52.

Connectors 60 extend between and connect mount plate 64 and brace plate 56. In the example shown, connectors 60 are formed as elongate rods that extend between and connect mount plate 64 and brace plate 56. The elongate rods can be rigid to facilitate force transmission. Connectors 60 are formed such that open spaces are formed circumferentially between different ones of connectors 60 and circumferentially between connectors 60 and base plate 62. The open spaces facilitate airflow over rotor 70, providing cooling to motor 28.

Retainer plate 54 is connected to support frame 52, such as by fasteners. Retainer plate 54 opposes and can abut mount plate 64. For example, both retainer plate 54 and mount plate 64 can include flat wall surfaces that interface with each other to at least partially enclose a gear chamber between retainer plate 54 and mount plate 64, as discussed in more detail below. The gear chamber can be formed by and between retainer plate 54 and mount plate 64. The toothed interface between pinion drive 30 and drive gear 94 can be formed and disposed within the gear chamber.

Drive housing 58 is connected to retainer plate 54. Pump 26 is supported by drive housing 58. For example, pump body 38, which can be formed as a cylinder among other options, can be connected to drive link housing 58 by a clamp, among other connection options. Pump 26 can be inserted into drive link housing 58 by shifting pump 26 laterally through pump opening 68 in drive link housing 58. The pump 26 can shift radially relative to the pump axis PA to mount to drive link housing 58.

Drive assembly 24 is configured to receive rotational output from rotational output assembly 22 and generate a linear reciprocating motion that drive assembly 24 inputs to pump 26 to power pumping by pump 26. Drive assembly 24 can also be referred to as a drive. Pinion drive 30 interfaces with drive gear 94 to provide a rotational input to drive assembly 24. Drive gear 94 is mounted to eccentric 92 to drive rotation of eccentric 92. The drive gear 94 is fixed to the eccentric 92 so that the eccentric 92 rotates 1:1 with the drive gear 94. Drive gear 94 includes a greater number of teeth than pinion drive 30. Drive gear 94 has a larger diameter than pinion drive 30. The toothed interface provides a gear speed reduction such that drive gear 94 rotates at a reduced rotational speed relative to the rotation speed of pinion drive 30. Drive gear 94 completes only a partial rotation for every full rotation by pinion drive 30.

Drive gear 94 is mounted to eccentric shaft 104 of eccentric 92. Eccentric 92 is supported by drive bearings 48*a*, 48*b*. Drive bearing 48*a* is supported by retainer plate 54. Drive bearing 48*b* is supported by support frame 52.

Specifically, drive bearing 48*b* is supported by mount plate 64 of support frame 52. Drive bearing 48*a* is larger than drive bearing 48*b*. In the example shown, pinion bearing 46*a* is a smallest one of the pinion bearings 46*a*, 46*b* and drive bearings 48*a*, 48*b*. Pinion bearing 46*b* is a largest one of the pinion bearings 46*a*, 46*b* and drive bearings 48*a*, 48*b*. The drive bearings 48*a*, 48*b* are intermediately sized relative to the pinion bearings 46*a*, 46*b*.

Eccentric driver 106 is disposed at an end of eccentric 92. Eccentric driver 106 is disposed at a free end of eccentric 92 and on an opposite side of retainer plate 54 from drive gear 94. Eccentric driver 106 is disposed to rotate around the rotational axis of drive gear 94. Specifically, eccentric driver 106 rotates offset from the center of rotation of the rest of the eccentric 92. Follower bearing 102 is disposed over eccentric driver 106. Follower bearing 102 is disposed between eccentric driver 106 and follower 98. Follower bearing 102 allows eccentric driver 106 to rotate relative to follower 98. Follower 98 is connected to eccentric driver 106 such that eccentric driver 106 can cause vertical displacement of follower 98 relative to the pump axis PA. Follower 98 is connected to drive link 96 such that movement of follower 98 causes displacement of drive link 96 relative to pump axis PA.

Drive link 96 is connected to follower 98 by drive pin 100. Drive link 96 extends into drive housing 58 through drive link opening 66 in drive housing 58. Pump 26 can be mounted to and dismounted from drive housing 58 by moving radially through pump opening 68 relative to the pump axis PA of pump 26. Pump 26 can be connected to drive housing 58 such that pump 26 is supported by pump frame 44, such as by pump body 38 being clamped to drive housing 58. The fluid displacer 36 of pump 26 is connected to drive link 96 at a location within drive housing 58 such that reciprocation of drive link 96 causes reciprocation of the fluid displacer 36. Follower 98 and follower bearing 102 are mounted on the eccentric driver 106 to follow a circular pattern that moves drive link 96 up and down along the pump axis PA, which reciprocates the fluid displacer 36 of pump 26 along the pump axis PA for pumping.

FIG. 4A is a cross-sectional view of fluid displacement assembly 20. FIG. 4B is an enlarged cross-sectional view of detail B in FIG. 4A. FIGS. 4A and 4B are discussed together. Supply line 16, spray gun 18, and fluid displacement assembly 20 of spray system 10 are shown.

Motor 28 and pinion drive 30 of rotational output assembly 22 are shown. Rotor 70, stator 114, axle 116, and motor bearings 118*a*, 118*b* of motor 28 are shown. First end wall 72, rotor body 76, and second end wall 74 of rotor 70 are shown. Pinion cap 78, fastener 80, and stud 82 of pinion drive 30 are shown. Pinion end 84*a*, pinion end 84*b*, and gear teeth section 86 of pinion drive 30 are also shown. Pinion cap 78 includes through bore 120. Stud 82 includes spline 88, post 90, and stud bore 124. Eccentric 92, drive gear 94, drive link 96, follower 98, drive pin 100, and follower bearing 102 of drive assembly 24 are shown. Eccentric 92 includes eccentric shaft 104 and eccentric driver 106. Fluid displacer 36 and pump body 38 of pump 26 are shown.

Pump frame 44 includes support frame 52, retainer plate 54, brace plate 56, drive housing 58, and connectors 60. Support frame 52 includes base plate 62 and mount plate 64.

Rotational output assembly 22, drive assembly 24, pump 26, pump frame 44, pinion bearings 46*a*, 46*b*, drive bearings 48*a*, 48*b*, and control panel 50 of fluid displacement assembly 20 are shown. Pump frame 44 supports rotational output assembly 22. Rotational output assembly 22 is mounted to pump frame 44 at dual mechanical interfaces formed between rotational output assembly 22 and pump frame 44. In the example shown, rotational output assembly 22 is mounted to pump frame 44 at a dynamic interface and a static interface.

Rotational output assembly 22 is mounted to pump frame 44 by the dynamic interface. Pump frame 44 supports the rotational output assembly 22 at the dynamic interface such that loads can be transmitted through the dynamic interface (e.g., from rotational output assembly 22 to pump frame 44). The dynamic interface is formed at a first end 110 of rotational output assembly 22. The dynamic interface supports the rotational output assembly 22 on pump frame 44 while allowing rotating components of rotational output assembly 22 to rotate relative to the pump frame 44. In the example shown, the dynamic interface is formed between pinion drive 30 and pump frame 44. Pinion drive 30 is supported on pump frame 44 by pinion bearings 46*a*, 46*b*.

Rotational output assembly 22 is mounted to pump frame 44 by the static interface. The static interface is formed such that loads can be transmitted through the static interface from rotational output assembly 22 to pump frame 44. In the example shown, the static interface is formed between pump frame 44 and motor 28. The static interface supports the rotational output assembly 22 such that a non-moving component of rotational output assembly 22 interfaces with pump frame 44 at the static interface. The static interface is formed at a second end 112 of rotational output assembly 22. The electromagnetic components of motor 28 are, at least partially, disposed axially between the locations of the dynamic interface and the static interface.

Pump frame 44 is connected to system frame 32 that mounts pump frame 44 to a support surface, such as a ground surface on a jobsite. Pump frame 44 and system frame 32 form a support 12 that supports fluid displacement assembly 20. In the example shown, wheels 34 are connected to the system frame 32 portion of support 12.

Support frame 52 can form one or more of the components of pump frame 44 that are connected to the system frame 32. In some examples, support frame 52 is the only component of pump frame 44 directly connected to the system support. Pump frame 44 supports rotational output assembly 22 and reacts loads to system frame 32 to facilitate operation of rotational output assembly 22.

Pump frame 44 is mechanically connected to rotational output assembly 22 at the second end 112 of rotational output assembly 22 to support rotational output assembly 22. In the example shown, brace plate 56 is connected to the portion of axle 116 extending axially outward through the opening in second end wall 74. Brace plate 56 is connected to base plate 62 and to connectors 60. For example, brace plate 56 can be connected to both base plate 62 and connectors 60 by fasteners, among other connection types.

Support frame 52 is connectable to rotational output assembly 22 and drive assembly 24 to support rotational output assembly 22 and drive assembly 24. Support frame 52 can be directly connected to a supporting frame, such as system frame 32 of support 12. In the example shown, base plate 62 is unitary with mount plate 64. Base plate 62 extends between and connects brace plate 56 to mount plate 64. With base plate 62 formed unitary with mount plate 64, base plate 62 can be considered to form a unitary connector between brace plate 56 and mount plate 64. Base plate 62 projects from mount plate 64 in second axial direction AD2 such that base plate 62 radially overlaps with motor 28. In the example shown, base plate 62 overlaps fully the electromagnetic components of motor 28 (e.g., windings of stator 114 and permanent magnets 140 of rotor 70).

Brace plate 56 is connected to base plate 62 and mount plate 64. Brace plate 56 is directly connected to base plate 62, such as by fasteners. Brace plate 56 is connected to mount plate 64 by connectors 60 that extend between and connect to brace plate 56 and mount plate 64. Brace plate 56 is further connected to mount plate 64 by base plate 62. Brace plate 56 interfaces with motor 28 to support motor 28. Specifically, brace plate 56 interfaces with a portion of axle 116 projecting outward from rotor 70 and stator 114.

Connectors 60 extend between brace plate 56 and mount plate 64. Connectors 60 further connect brace plate 56 and mount plate 64. Connectors 60 are formed as rods, in the example shown. Connectors 60 can be rigid and configured to transmit loads between brace plate 56 and support frame 52. In the example shown, connectors 60 are formed as rigid rods that connect brace plate 56 and mount plate 64 such that forces reacting loads can be transmitted through connectors 60. Motor 28 is captured axially between mount plate 64 and brace plate 56. Motor 28 is captured such that motor 28 is suspended above base plate 62 and suspended within a motor chamber formed axially between mount plate 64 and brace plate 56 and defined circumferentially around the motor 28 by base plate 62 and connectors 60.

Mount plate 64 is disposed between motor 28 and gear chamber 124. Mount plate 64 can be considered to form a vertical portion of the support frame 52. Plate flange 128 is an axially extending portion of mount plate 64. Plate flange 128 extends axially relative to motor axis MA. In the example shown, plate flange 128 extends in first axial direction AD1 relative to a base portion of mount plate 64. Retainer plate 54 is connected to support frame 52. Specifically, retainer plate 54 is connected to mount plate 64. A face of retainer plate 54 interfaces with a face of mount plate 64. The faces can be flat surfaces. The faces interface to radially enclose the gear chamber 124 about the motor axis MA. Retainer plate 54 can be connected to mount plate 64 in any desired manner, such as by fasteners (e.g., bolts).

Retainer plate 54 and mount plate 64 mate at an interface extending fully about the gear chamber 124. Retainer plate 54 can be connected to support frame 52 in any desired manner to form the gear chamber 124, such as by fastening retainer plate 54 to support frame 52 by bolts. The mating interface between retainer plate 54 and mount plate 64 extends about the motor axis MA and the drive axis DA of the drive gear 94. The gear chamber 124 has an irregular surface extending around the motor axis MA at the interface between retainer plate 54 and mount plate 64. The irregular surface is formed such that radial lines extending from motor axis MA to the mating interface between retainer plate 54 and mount plate 64 that extends about gear chamber 124 have different lengths when extending in different directions from the motor axis MA. The irregular surface can also include one or more locations located at common radial distances from the motor axis MA.

The gear chamber 124 is circumferentially closed about the motor axis MA by the interface between retainer plate 54 and mount plate 64. In the example shown, mount plate 64 includes the plate flange 128 that extends axially from a vertical plate portion of mount plate 64. Plate flange 128 extends in first axial direction AD1, away from motor 28. The plate flange 128 extends to radially overlap with the toothed interface 130 formed between pinion drive 30 and drive gear 94. In the example shown, plate flange 128 extends axially beyond the toothed interface 130 from the vertical portion of mount plate 64 such that plate flange 128 fully radially overlaps the toothed interface 130. The interface between retainer plate 54 and mount plate 64 is disposed between toothed interface 130 and the interface between drive link 96 and pump 26. The interface between retainer plate 54 and mount plate 64 is disposed axially between the pump 26 and the motor 28, along the motor axis MA. The interface between retainer plate 54 and mount plate 64 is formed at a mating interface between flat faces to seal the radial surface of gear chamber 124. It is understood that retainer plate 54 and mount plate 64 can directly interface (e.g., by direct contact) or indirectly interface (e.g., by a component, such as a seal, spacer, etc., disposed therebetween) to define the gear chamber 124.

Pump frame 44 supports pinion bearings 46*a*, 46*b* and drive bearings 48*a*, 48*b*. Pinion opening 132 extends through the pump frame 44 from an exterior of pump frame 44 and into gear chamber 124. In the example shown, pinion opening 132 is formed in mount plate 64. Pinion opening 132 extends fully through mount plate 64 between an inner axial side of mount plate 64 (oriented in first axial direction AD1 and into gear chamber 124) and an outer axial side of mount plate 64 (oriented in second axial direction AD2 and towards motor 28).

Drive bore 138 is formed in mount plate 64. In the example shown, drive bore 138 extends partially through mount plate 64. An axial end of drive bore 138, opposite the end of the drive bore 138 at gear chamber 124, is closed.

Drive opening 136 extends through the pump frame 44 from an exterior of pump frame 44 and into gear chamber 124. In the example shown, drive opening 136 is formed in retainer plate 54. Drive opening 136 extends fully through retainer plate 54 between an outer axial side of retainer plate 54 (oriented in first axial direction AD1 toward drive link 96 and away from motor 28 and gear chamber 124) and an inner axial side of retainer plate 54(oriented in second axial direction AD2 and towards gear chamber and motor 28).

Pinion bore 134 is formed in retainer plate 54. In the example shown, pinion bore 134 extends partially through retainer plate 54. An axial end of pinion bore 134, opposite the end of pinion bore 134 at gear chamber 124, is closed.

Pinion opening 132 can also be referred to as a bearing opening or pinion bore. Drive opening 136 can also be referred to as a bearing opening or drive bore. Pinion bore 134 can also be referred to as a bearing chamber or pinion chamber. Drive bore 138 can also be referred to as a bearing chamber or drive chamber. Pinion opening 132, drive opening 136, pinion bore 134, and drive bore 138 can each be referred individually to as a bearing bore.

Rotational output assembly 22 is supported by pump frame 44. Rotational output assembly 22 is disposed on motor axis MA and extends between first end 110 to second end 112. First end 110 can be considered to form an output end configured to provide a rotational output from motor 28. Second end 112 can be an electrical input end configured to receive electrical power to provide electrical input to stator 114 to power operation of motor 28. For example, electrical wires can extend into motor 28 through the axle 116 to connect with stator 114 and provide power to stator 114. In the example shown, rotor 70 rotates radially around the stator 114. As such, motor 28 is configured as an outer rotator motor. It is understood, however, that in other examples the rotor 70 can be at least partially disposed within the stator 114 to rotate within the stator 114. Some examples of motor 28 can thus be formed as an inner rotator motor.

In the example shown, rotor 70 includes an array of permanent magnets on an inner radial side of rotor body 76.

Stator 114 generates electromagnetic fields that interact with a plurality of magnetic elements of rotor 70 to rotate rotor 70 about stator 114. Electric power is provided to the stator 114 to cause the stator 114 to generate magnetic flux, which interacts with the permanent magnets 140 to drive rotation of rotor 70. Motor 28 can be configured as a dual directional motor 28 such that rotor 70 can rotate in either rotational direction relative to the stator 114 (e.g., either clockwise or counterclockwise when viewed along axis MA in first axial direction AD1).

First end wall 72 is disposed at a first axial end of rotor 70 along the motor axis MA. The first end wall 72 is formed at the output end of rotational output assembly 22. In the example shown, first end wall 72 of rotor 70 is closed such that no component extends fully through first end wall 72. First end wall 72 is closed such that no rod or other structural support component extends entirely axially through motor 28. Second end wall 74 is disposed at a second axial end of rotor 70 along the motor axis MA, opposite the first axial end. Second end wall 74 is formed at the electrical input end of rotational output assembly 22. Second end wall 74 is not closed and includes an opening through which the axle 116 projects. Second end wall 74 extends radially inward to axially overlap with the stator 114.

The rotor body 76 extends axially between the first end wall 72 and the second end wall 74. In the example shown, the first end wall 72 and the rotor body 76 are unitary and formed as a single component, such as by casting. The second end wall 74 is separately formed and connected to rotor body 76. For example, the second end wall 74 can be connected to rotor body 76 by fasteners, adhesive, welding, press-fit, interference fit, or by other forms of connection.

Stator 114 is disposed within rotor 70. In the example shown, stator 114 is fully disposed within rotor 70. Stator 114 is bracketed axially by first end wall 72 and second end wall 74 along motor axis MA. Axle 116 is partially disposed within rotor 70 and stator 114 and extends out of rotor 70 through second end wall 74. The axle 116 and electromagnetic components of motor 28 (e.g., windings and permanent magnets 140) radially overlap. Axle 116 extends outward from motor 28 in second axial direction AD2. Second end wall 74 includes an opening that is aligned on the motor axis MA and through which the axle 116 extends. For example, the opening can be a circular opening that is coaxial with the motor axis MA.

Rotor 70 is rotatably supported by static components of motor 28. In the example shown, rotor 70 is mounted to axle 116 to rotate about axle 116. Specifically, rotor 70 is mounted to axle 116 by motor bearings 118*a*, 118*b*. As shown, axle 116 does not extend through both axial ends of the rotor 70. First end wall 72 is closed such that axle 116 cannot extend through first end wall 72. Second end wall 74 is open such that axle 116 can project through second end wall 74. Motor bearing 118*a* is at the first axial end of rotor 70. In the example shown, a radially inner race of motor bearing 118*a* interfaces with rotor 70 and a radially outer race of motor bearing 118*a* interfaces with axle 116. Specifically, the inner race of motor bearing 118*a* interfaces with a portion of first end wall 72 extending axially away from gear teeth section 86 of pinion drive 30. Motor bearing 118*b* is at the second axial end of rotor 70. A radially inner race of motor bearing 118*b* interfaces with axle 116 and a radially outer race of motor bearing 118*b* interfaces with rotor 70. Specifically, the outer race of motor bearing 118*b* interfaces with second end wall 74. In the example shown, at least a portion of motor bearing 118*a* is radially inward of motor bearing 118*b* such that motor bearing 118*a* is closer to the motor axis MA than motor bearing 118*b*. Motor bearing 118*a* is smaller than motor bearing 118*b* in the example shown.

Up to the full axial lengths of one or more of the permanent magnets 140 can be radially overlapped by the stator 114. In the example shown, the permanent magnets 140 are disposed axially between the dynamic interface (between and pinion drive 30 and pinion bearings 46*a*, 46*b*) and the static interface (between pump frame 44 and axle 116). In the example shown, the full axial length of the permanent magnets 140 is disposed axially between the dynamic interface and the static interface.

Pinion drive 30 is disposed at first end 110 of rotational output assembly 22. In the example shown, pinion drive 30 is formed as an axial-most component of the rotational output assembly 22 in the first axial direction AD1. Pinion end 84*a* of pinion drive 30 forms a distal end of rotational output assembly 22. Pinion drive 30 interfaces with pinion bearings 46*a*, 46*b* to form the dynamic interface between rotational output assembly 22 and pump frame 44.

Pinion drive 30 includes first pinion end 84*a* spaced axially from second pinion end 84*b*. Pinion end 84*a* is formed as a cylindrical surface in the example shown. Pinion end 84*a* is configured to interface with pinion bearing 46*a*, such as the rollers of pinion bearing 46*a*, such that pinion end 84*a* is supported by pinion bearing 46*a*. Pinion end 84*b* is formed as a cylindrical surface in the example shown. Pinion end 84*b* is configured to interface with pinion bearing 46*a*, such as the rollers of pinion bearing 46*b*, such that pinion end 84*b* is supported by pinion bearing 46*b*. Gear teeth section 86 is disposed axially between the pinion ends 84*a*, 84*b*.

In the example shown, pinion drive 30 is formed as a pinion cap 78 mounted on a stud 82. The pinion cap 78 is formed separately from and mounted to rotor 70. The stud 82 is formed separately from and connected to both the rotor 70 and pinion cap 78. Pinion cap 78 is attached to the rotor 70 and rotates with the rotor 70. Pinion cap 78 is disposed coaxially with rotor 70 to rotate on motor axis MA. Pinion drive 30 is formed such that pinion end 84*a*, pinion end 84*b*, and gear teeth section 86 are formed by the pinion cap 78.

In the example shown, pinion drive 30 is formed separately from and connected to rotor 70. It is understood, however, that other examples can include pinion drive 30 formed integral with rotor 70. In both examples, pinion drive 30 is supported by pinion bearings 46*a*, 46*b* disposed on opposite axial sides of the gear teeth section 86 formed by the pinion teeth 87 of the pinion drive 30.

Pinion cap 78 is mounted on stud 82. Stud 82 can be formed integral (e.g., contiguous material) with the rotor 70 or separately from and attached to the rotor 70. In the example shown, stud 82 is connected to first end wall 72 of rotor 70. Stud 82 can be connected to rotor 70 by the material forming first end wall 72 being cast over a portion of stud 82. In the example shown, the material of rotor 70 is cast over spline 88 of stud 82. The post 90 of stud 82 extends axially outward from rotor 70 in first axial direction AD1. The post 90 is not overcast by the material of rotor 70 and is instead exposed. Stud bore 124 extends into post 90. In the example shown, stud bore 124 extends fully through stud 82 such that a smaller diameter portion can form a vent port that prevents overpressurization within stud bore 124 and the larger diameter fastener mount portion 142 receives fastener 80. It is understood, however, that some examples of stud bore 124 extend only partially through stud 82. Stud bore 124 extends coaxial with the motor axis MA. The fastener mount portion 142 of the stud bore 124 does not extend into the motor 28 and does not radially overlap with rotor 70.

Stud 82 is mounted to rotor 70 such that stud 82 does not extend into or radially overlap with components of motor 28 other than first end wall 72. Spline 88 is spaced axially from motor bearing 118*a* in first axial direction AD1. Spline 88 does not radially overlap with either motor bearing 118*a*, 118*b* relative to the motor axis MA, in the example shown. At least a portion of the radially outer surface of spline 88 is disposed radially inward of the radially inner side of motor bearing 118*a* relative to the motor axis MA. In some examples, the radially outer surface of spline 88 is disposed fully radially inward of the radially inner side of motor bearing 118*a* relative to the motor axis MA. As such, some examples of stud 82 can be formed such that no portion of spline 88 extends radially outward of the radially inner side of motor bearing 118*a* relative to the motor axis MA. Such examples include a pinion drive 30 that does not axially overlap with one or more, up to all, of the bearings within motor 28 (e.g., motor bearings 118*a*, 118*b*) relative to the motor axis MA. Stud 82 that does not axially overlap with one or both of the motor bearings 118*a*, 118*b* relative to the motor axis MA. Stud 82 does not extend into or radially overlap with the electromagnetic components of motor 28 (e.g., the permanent magnets 140 of rotor 70 and windings of stator 114) relative to the motor axis MA, in the example shown.

Pinion cap 78 rotates with the rotor 70 on the motor axis MA. Pinion cap 78 is coaxial with the rotor 70. Pinion cap 78 is directly connected to the stud 82. Pinion cap 78 is further fixed to the stud 82 by fastener 80. Fastener 80 can be a bolt that extends within the pinion cap 78 from the pinion end 84*a* and through pinion end 84*b*. In the example shown, pinion end 84*a* is formed at a first axial end of pinion cap 78, pinion end 84*b* is formed at a second axial end of pinion cap 78, and gear teeth section 86 is formed by pinion cap 78 axially between the pinion ends 84*a*, 84*b*.

Through bore 120 extends through pinion cap 78 and facilitates mounting pinion cap 78 on stud 82. In the example shown, through bore 120 extends fully through pinion cap 78. Through bore 120 includes mounting bore 122 that forms a radially enlarged portion of through bore 120 relative to the portion that fastener 80 passes through. Pinion cap 78 is mounted to stud 82 to prevent relative rotation between pinion cap 78 and rotor 70.

In the example shown, the stud 82 includes external threading that interfaces with internal threading of the pinion cap 78. Specifically, the external threading is formed on post 90 and the internal threading is formed within the mounting bore 122 portion of the through bore 120. The pinion cap 78 and stud 82 mate at a threaded interface, which can be referred to as relative cap threading. The orientation of the relative cap threading can be in a first direction (e.g., left-hand threading or right-hand threading). Stud 82 also includes internal threading within stud bore 124. The stud bore 124 thus forms a receiver of the stud 82 configured to receive the fastener 80. The internal threading of the stud 82 interfaces with external threading on the end of the fastener 80 at a threaded interface, which can be referred to as relative fastener threading. The orientation of the relative fastener threading between the stud 82 and fastener 80 can be in a second direction opposite of the first direction (e.g., the other one of the left-hand threading and the right-hand threading). Having threaded interfaces formed by threads formed in both directions ensures that the connection between stud 82 and pinion cap 78 is maintained even if the motor 28 reverses direction of rotation. In the example shown, the threaded interface between pinion cap 78 and stud 82 radially overlaps with the threaded interface between fastener 80 and stud 82 relative to the motor axis MA.

In other examples, pinion cap 78 is keyed (e.g., hexed) to the stud 82 instead of a threaded interface to prevent relative rotation even when the rotor 70 reverses direction. For example, the stud 82 can include a cross-sectional shape that is non-circular orthogonal to motor axis MA and the chamber of pinion cap 78 (e.g., mounting bore 122) can similarly include a mating cross-sectional shape that is non-circular orthogonal to motor axis MA. The mating non-circular shapes prevent relative rotation between pinion cap 78 and stud 82. For example, the cross-sections can be oval, square, triangular, rectangular, star shaped, or another polygonal shape. Fastener 80 can extend through pinion cap 78 to secure pinion cap 78 to stud 82 while the non-circular interface prevents loosening and relative rotation. In other examples, pinion cap 78 can be fixed to stud 82 by adhesive, welding, etc.

Pinion cap 78 extends in first axial direction AD1 relative to motor 28. Pinion cap 78 extends through pinion opening 132 formed through mount plate 64. Pinion cap 78 extends fully through the gear chamber 124 formed between mount plate 64 and retainer plate 54. First pinion end 84 is disposed in pinion bore 134 formed in retainer plate 54.

Pinion cap 78 does not extend into motor 28. Pinion cap 78 does not radially overlap with rotor 70 or stator 114 relative to the motor axis MA. In the example shown, pinion cap 78 does not radially overlap with rotor 70 or stator 114 relative to the pump axis PA. Pinion cap 78 does not radially overlap with permanent magnets 140 relative to the motor axis MA. Pinion cap 78 does not extend into any portion of rotor 70. Pinion cap 78 does not radially overlap any portion of stud 82 interfacing with rotor 70 relative to the motor axis MA. Pinion cap 78 is spaced axially in first axial direction AD1 from motor bearings 118*a*, 118*b* and is not disposed between the motor bearings 118*a*, 118*b*. Pinion cap 78 is located entirely outside of the motor 28.

Pinion drive 30 is supported by pinion bearings 46*a*, 46*b*. In the example shown, the pinion cap 78 interfaces with the pinion bearings 46*a*, 46*b* on the inner radial sides of the pinion bearings 46*a*, 46*b*. The pinion bearing 46*a* interfaces with pinion end 84*a*. The pinion bearing 46*b* interfaces with pinion end 84*b*. The outer races of the pinion bearings 46*a*, 46*b* interface with the pump frame 44. The pinion bearings 46*a*, 46*b* can be roller bearings (e.g., needle type bearings), among other options. Pinion bearings 46*a*, 46*b* are supported by and can be captured on pump frame 44. In the example shown, pinion bearing 46*a* is supported by retainer plate 54 and pinion bearing 46*b* is supported by mount plate 64.

Pinion bearing 46*a* is disposed in pinion bore 134 formed in retainer plate 54. Pinion end 84*a* interfaces with and is rotationally supported by pinion bearing 46*a*. Pinion bearing 46*b* is at least partially disposed within pinion opening 132 formed through the mount plate 64. Second pinion end 84 interfaces with and is rotationally supported by pinion bearing 46*b*. The gear teeth section 86 of the pinion cap 78 is disposed between the first pinion end 84 and the second pinion end 84. The pinion teeth 87 form the gear teeth section 86 and are formed in an array that extends circumferentially about pinion cap 78. In this way, the pinion cap 78 includes the exterior gear teeth section 86 disposed axially between pinion bearing 46*a* and pinion bearing 46*b* with rotational output assembly 22 mounted to pump frame 44.

Pinion cap 78 does not extend into motor 28. Stud 82 does not extend into motor 28. Pinion drive 30 does not extend into the motor 28. Pinion cap 78 does not radially overlap with any portion of the rotor 70 or stator 114 relative to the motor axis MA. Motor 28 does not includes a shaft that extends from within the motor 28 to outside of the motor 28 to interface with drive gear 94. No portion of pinion drive 30 or pinion cap 78 interfaces with or radially overlaps with the motor bearings 118*a*, 118*b* relative to the motor axis MA. Motor 28 does not include an overhung pinion. Motor 28 does not include a straddle mounted pinion that projects from a shaft that extends within the motor 28. Pinion drive 30 and pinion cap 78 do not interface with, extend into, or radially overlap (relative to the motor axis MA) with either of motor bearings 118*a*, 118*b*, such that loads generated by pump 26 are not transmitted to motor bearings 118*a*, 118*b* through pinion drive 30 or pinion cap 78. The configuration of rotational output assembly 22 thereby isolates motor 28 from the reciprocation forces, decreasing wear, and increasing the operational life of motor 28.

Pinion bearings 46*a*, 46*b* are supported on two housing components (retainer plate 54 and mount plate 64) that are not components of the motor 28 itself. Pinion bearings 46*a*, 46*b* are supported by pump frame 44. The pinion bearings 46*a*, 46*b* are not disposed within the motor 28. Pinion bearings 46*a*, 46*b* do not radially overlap with components of the rotor 70 or stator 114 relative to the motor axis MA. Pinion bearings 46*a*, 46*b* can support both dynamic motor loads and the pump reaction forces generated by reciprocation of fluid displacer 36 during pumping. The pinion bearings 46*a*, 46*b* are isolated from the motor 28 such that loads experienced by the pinion bearings 46*a*, 46*b* are not transmitted to the components of motor 28, thereby isolating those components, such as motor bearings 118*a*, 118*b*, from loads generated by pump 26 and transmitted to gear train formed by pinion drive 30 and drive gear 94.

Pinion bearings 46*a*, 46*b* are the only rotational support components that support rotational output assembly 22 on pump frame 44. In the example shown, pinion bearings 46*a*, 46*b* are the only two bearings supporting the rotational output assembly 22 on the pump frame 44. The motor bearings 118*a*, 118*b* are disposed within motor 28 and do not directly interface with the pump frame 44. Instead, the motor bearings 118*a*, 118*b* interface with rotor 70 and axle 116, which axle 116 extends out of rotor 70 to interface with pump frame 44. The pinion bearings 46*a*, 46*b* are the only components of fluid displacement assembly 20 that interface with both pump frame 44 and rotational output assembly 22.

The exterior gear teeth section 86 of pinion cap 78 engages drive teeth section 108 of drive gear 94. The toothed interface 130 between pinion cap 78 and drive gear 94 is formed within a gear chamber 124. An axial length of the toothed interface 130 is defined by the one of drive gear 94 and pinion drive 30 formed with a shorter axial tooth length. In the example shown, the pinion teeth 87 forming gear teeth section 86 are axially longer than the drive teeth 109 forming drive teeth section 108. Such a configuration facilitates mounting and dismounting of rotational output assembly 22 on pump frame 44 and forming the toothed interface 130 between pinion drive 30 and drive gear 94 to facilitate force transmission. Gear teeth section 86 engages with the full axial length of drive teeth section 108. The longer teeth of gear teeth section 86 facilitates alignment between gear teeth section 86 and drive teeth section 108 during mounting and subsequent operation of rotational output assembly 22.

Gear chamber 124 is formed between retainer plate 54 and mount plate 64. The pinion teeth 87 of gear teeth section 86 intermesh with the drive teeth 109 of drive teeth section 108 such that rotation of pinion cap 78 drives rotation of drive gear 94. In the example shown, rotor 70 can rotate in both rotational directions, such that both circumferential sides of each tooth experiences wear, rather than only one side experiencing wear. Such distributed wear facilitates increased operational life for drive assembly 24 and rotational output assembly 22.

The drive teeth section 108 of drive gear 94 has a larger diameter relative to the rotational axis of drive gear 94 than a diameter of the gear teeth section 86 of pinion cap 78 relative to a rotational axis of pinion cap 78. Drive gear 94 thus rotates with pinion cap 78 but at a slower rate due to the gear reduction between the pinion cap 78 and the drive gear 94.

Pinion end 84*b* of pinion cap 78 interfaces with pinion bearing 46*b* within pinion opening 132 through mount plate 64. Pinion end 84*b* interfacing with pinion bearing 46*b* encloses the pinion opening 132 through mount plate 64 between gear chamber 124 and an exterior of pump frame 44. Enclosing the gear chamber 124 inhibits flow of contaminants to the toothed interface 130 between gear teeth section 86 and drive teeth section 108. Pinion bearing 46*b* is disposed axially between gear teeth section 86 and rotor 70 such that the pinion opening 132 disposed axially between the toothed interface 130 and the rotor 70 is sealed by pinion bearing 46*b* and pinion drive 30.

Drive assembly 24 is supported by pump frame 44. Specifically, drive assembly 24 is connected to and supported by retainer plate 54 and mount plate 64. Drive gear 94 is supported by eccentric 92. The drive gear 94 is fixed to the eccentric 92 so that the eccentric 92 rotates 1:1 with the drive gear 94. Specifically, drive gear 94 is mounted to eccentric shaft 104 of eccentric 92. A first end of eccentric shaft 104 extends in first axial direction AD1 from drive gear 94. The first end of eccentric shaft 104 extends through drive opening 136 in retainer plate 54 to project out of the gear chamber 124. A second end of eccentric shaft 104 extends in second axial direction AD2 from drive gear 94. The second end of eccentric shaft 104 extends into drive bore 138 formed in mount plate 64. The drive bore 138 is closed at an axial end opposite the end of the drive bore 138 through which the eccentric shaft 104 extends into the drive bore 138.

The eccentric 92 is supported by drive bearings 48*a*, 48*b*, which can also be roller bearings (e.g., needle type bearings), similar to pinion bearings 46*a*, 46*b*. The drive bearings 48*a*, 48*b* rotatably support eccentric 92 and drive gear 94. The drive bearings 48*a*, 48*b* are supported by pump frame 44. Specifically, drive bearing 48*a* is supported by retainer plate 54 and drive bearing 48*b* is supported by mount plate 64. Drive bearing 48*a* is disposed within the drive opening 136 through retainer plate 54 and interfaces with eccentric shaft 104 to support eccentric 92 and drive gear 94. Drive bearing 48*b* is disposed within the drive bore 138 within mount plate 64 and interfaces with eccentric shaft 104 to support eccentric 92 and drive gear 94.

The end of eccentric shaft 104 extending out of gear chamber 124 interfaces with drive bearing 48*a* within drive opening 136 through retainer plate 54. The eccentric shaft 104 interfacing with drive bearing 48*a* encloses the openings through retainer plate 54 between gear chamber 124 and an exterior of pump frame 44. Enclosing the gear chamber 124 inhibits flow of contaminants to the toothed interface 130 between gear teeth section 86 and drive teeth section 108. It is understood that gear chamber 124 can be considered to be enclosed, in some examples, even where a small bore extends through pump frame 44 between the gear chamber 124 and the exterior of the pump frame 44. For example, one or more vent openings can extend through the retainer plate 54 and mount plate 64. In the example shown, the vent opening is radially offset from the rotational axis of the drive gear 94 and the motor axis MA. The vent opening is on an opposite radial side of the toothed interface 130 from the pinion drive 30, relative to the motor axis MA. The vent opening is radially further from the motor axis MA than the toothed interface 130 and the eccentric 92.

The toothed interface 130 is formed at a location axially between the first drive bearing 48*a* and the second drive bearing 48*b* relative to the motor axis MA, and axially between the first pinion bearing 46*a* and the second pinion bearing 46*b* relative to the motor axis MA. The intermediate location of the toothed interface 130 relative to the drive bearings 48*a*, 48*b* and pinion bearings 46*a*, 46*b* balances loads transmitted through that toothed interface 130 and facilitates transfer of those loads to the pump frame 44. At least one drive bearing 48*a*, 48*b* is disposed on an opposite axial side of the toothed interface 130 from at least one pinion bearing 46*a*, 46*b* (e.g., drive bearing 48*a* and pinion bearing 46*b*). In the example shown, drive bearing 48*a* and pinion bearing 46*a* are disposed on a same first axial side of the toothed interface 130 while drive bearing 48*b* and pinion bearing 46*b* are disposed on a same second axial side of the toothed interface 130. The first axial side is opposite the second axial side, taken along the motor axis MA.

Drive bearing 48*a* is disposed to radially overlap with pinion bearing 46*a* relative to the motor axis MA. Drive bearing 48*b* is disposed to radially overlap with pinion bearing 46*b* relative to the motor axis MA. The radially overlapping configurations of drive bearings 48*a*, 48*b* and pinion bearings 46*a*, 46*b* provides for a compact drive system. The radially overlapping drive bearings 48*a*, 48*b* and pinion bearings 46*a*, 46*b* further facilitate counteracting the pump load generated by reciprocation of fluid displacer 36 to pump the fluid.

In the example shown, the pinion bearing 46*b* is larger than the drive bearing 48*a*, the drive bearing 48*a* is larger than the drive bearing 48*b*, and the drive bearing 48*b* is larger than the pinion bearing 46*a*. Drive bearings 48*a*, 48*b* and pinion bearings 46*a*, 46*b* are disposed with a cross-wise configuration. One example of a cross-wise configuration includes the larger bearing of each bearing set disposed on an opposite axial side of the toothed interface 130 and are disposed on different rotational axes (e.g., drive bearing 48*a* and pinion bearing 46*b*). Another example of a cross-wise configuration includes the smaller bearing of each bearing set disposed on an opposite axial side of the toothed interface 130 and disposed on different rotational axes (e.g., drive bearing 48*b* and pinion bearing 46*b*). The example shown includes a dual cross-wise configuration of drive bearings 48*a*, 48*b* and pinion bearings 46*a*, 46*b*. The crosswise positioning of the larger and smaller bearings supporting eccentric 92 and pinion cap 78 facilitates balancing the pump loads generated by reciprocation of fluid displacer 36, reducing wear on the drive bearings 48*a*, 48*b* and pinion bearings 46*a*, 46*b* and providing for increased operational life.

The cross-wise bearings configurations further facilitate mounting and dismounting of rotational output assembly 22 and drive assembly 24 on pump frame 44. For example, rotational output assembly 22 can be pulled in second axial direction AD2 away from mount plate 64. Pinion drive 30 is disengaged from pinion bearings 46*a*, 46*b* while pinion bearings 46*a*, 46*b* remain captured on pump frame 44. Drive assembly 24 and retainer plate 54 can be pulled in first axial direction AD1 away from mount plate 64. Eccentric shaft 104 disengages from drive bearing 48*b* as drive assembly 24 is pulled in first axial direction AD1. Drive bearing 48*b* remains captured on mount plate 64. Drive bearing 48*a* and pinion bearing 46*a* remain captured on retainer plate 54 as drive assembly 24 is removed from pump frame 44.

Eccentric 92 includes eccentric driver 106 formed on a portion of eccentric 92 on an opposite axial side of retainer plate 54 from drive gear 94. The eccentric driver 106 rotates offset from the center of rotation of the rest of the eccentric 92. The eccentric driver 106 rotates offset from and around the rotational axis DA of the drive gear 94. Follower 98 and follower bearing 102 are mounted on the eccentric driver 106 to follow a circular pattern that moves drive link 96 up and down along pump axis PA. Fluid displacer 36, which is formed as a piston in the example shown, is connected to drive link 96 to be driven in a reciprocating manner by drive link 96. Reciprocating fluid displacer 36 causes pumping by pump 26. In the example shown, the pump 26 is formed as a double displacement pump that outputs spray fluid during a first pump stroke in a first direction along the pump axis PA and outputs spray fluid during a second pump stroke in a second direction along the pump axis PA opposite the first direction along the pump axis PA.

Fluid displacement assembly 20 provides significant advantages. Pinion drive 30 is connected to rotor 70 to receive the rotational output from motor 28 and rotates coaxially with rotor 70. Pinion drive 30 is formed separately from rotor 70 and is supported by pinion bearings 46*a*, 46*b*. Pinion cap 78 mechanically connects motor 28 to pump frame 44 at the first end 110 of rotational output assembly 22, which is the output end of rotational output assembly 22.

Pinion drive 30 and pinion bearings 46*a*, 46*b* are disposed to counteract pump reaction forces and transmit those pump reaction forces to pump frame 44, thereby protecting motor 28 from experiencing the pump reaction forces. The gear teeth section 86 is disposed axially between the pinion bearings 46*a*, 46*b*. Loads are transmitted to the pinion drive 30 at a location axially between the pinion bearings 46*a*, 46*b* to be counteracted by the pinion bearings 46*a*, 46*b*. Pinion cap 78 is mounted to stud 82 to prevent loosening and relative rotation (e.g., by the dual directional threading). Stud 82 is formed from a harder and more durable material than first end wall 72 of rotor 70 that stud 82 is connected to. The durable material of stud 82 facilitates transmitting torque through the threaded interface between stud 82 and pinion cap 78.

Figure 5:
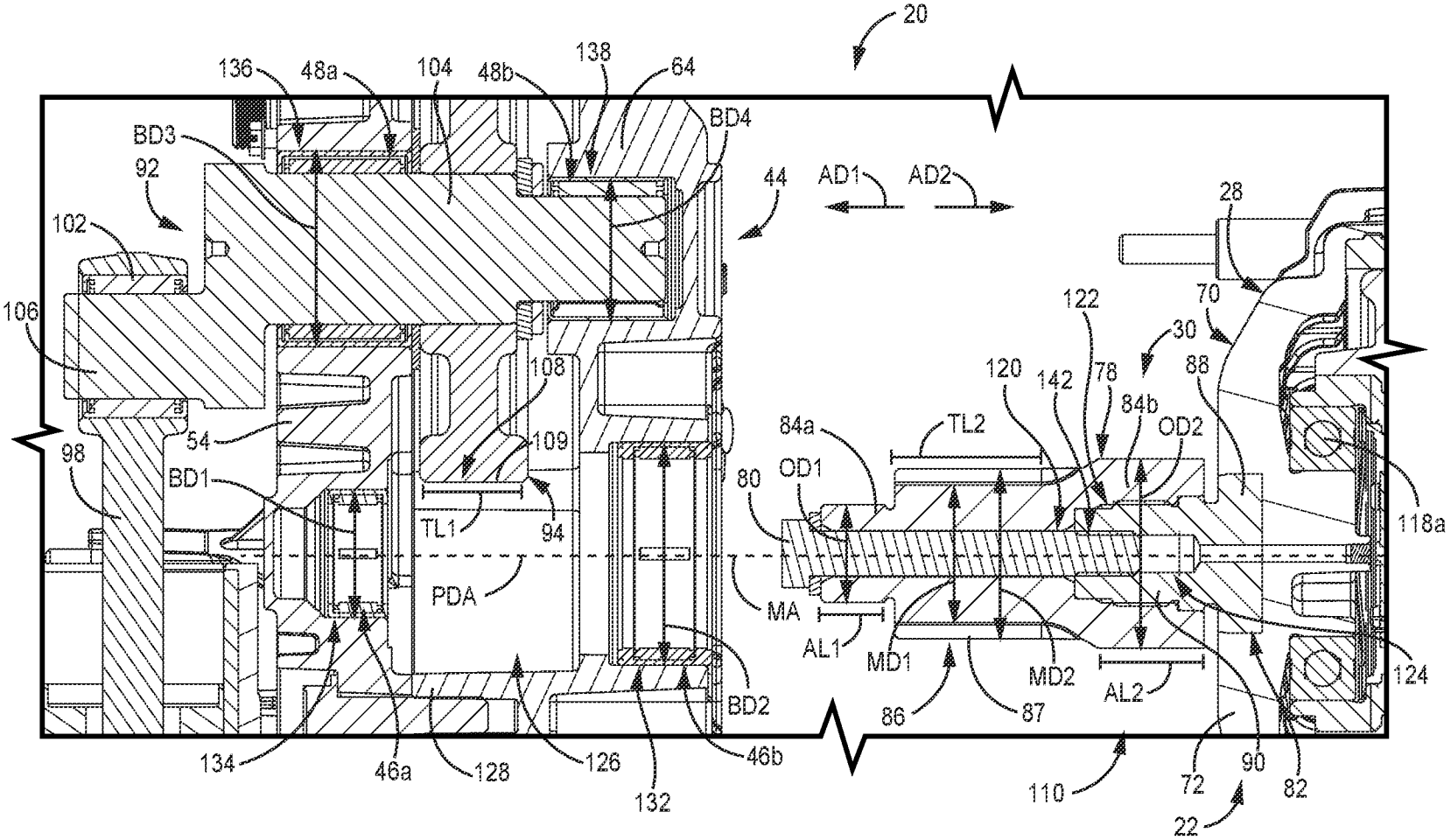
FIG. 5 is an enlarged cross-sectional view of an interface between a rotational output assembly and a pump frame showing the rotational output assembly exploded away from the pump frame.

FIG. 5 is an enlarged cross-sectional view of fluid displacement assembly 20 showing rotational output assembly 22 exploded away from pump frame 44. Pump frame 44, rotational output assembly 22, drive assembly 24, pinion bearings 46*a*, 46*b*, pump 26, and drive bearings 48*a*, 48*b* of fluid displacement assembly 20 are shown.

Pump frame 44 is configured to support rotational output assembly 22 to facilitate rotational output assembly 22 powering pumping by the pump 26 via drive assembly 24. Rotational output assembly 22 is mountable to and dismountable from pump frame 44 such that rotational output assembly 22 can be dismounted from pump frame 44 for repair or maintenance. The same or a different rotational output assembly 22 can then be mounted to pump frame 44 to power drive assembly 24. Rotational output assembly 22 can be mounted to and dismounted from pump frame 44 without breaking the connection between components of pump frame 44 defining gear chamber 126. Rotational output assembly 22 is mountable to the pump frame 44 by movement of the rotational output assembly 22 in first axial direction AD1 along the motor axis MA. Rotational output assembly 22 is dismountable from the pump frame 44 by movement of the rotational output assembly 22 in second axial direction AD2 opposite the first axial direction AD1.

In some examples, drive assembly 24 can be mountable to and dismountable from pump frame 44 such that drive assembly 24 can be dismounted from pump frame 44 for repair or maintenance. The same or a different drive assembly 24 can be mounted to pump frame 44 to connect with pinion drive 30 to receive the rotational output from pinion drive 30.

The dynamic and static interfaces between rotational output assembly 22 and pump frame 44 support the rotational output assembly 22 relative to the pump frame 44 to react rotational loads and pump reaction forces. The forces are transmitted to pump frame 44 and through pump frame 44 to the ground or other support surface. The dynamic interface is formed at a first end 110 of rotational output assembly 22. The static interface is formed at a second end 112 (best seen in FIG. 4B) of rotational output assembly 22.

The toothed interface 130 between drive gear 94 and pinion drive 30 is formed in gear chamber 126. Pump frame 44 defines the gear chamber 126. The toothed interface 130 between rotational output assembly 22 and drive assembly 24 is enclosed within gear chamber 126. Gear chamber 126 is formed axially between retainer plate 54 and mount plate 64 relative to the motor axis MA. A portion of gear chamber 126 between retainer plate 54 and mount plate 64 is shown. Pinion opening 132 is formed fully through mount plate 64. Drive opening 136 is formed fully through retainer plate 54. Drive bore 138 is formed in mount plate 64. Pinion bore 134 is formed in retainer plate 54.

Pinion opening 132 extends through the pump frame 44 from an exterior of pump frame 44 and into gear chamber 126. In the example shown, pinion opening 132 is formed through the mount plate 64 and provides an opening allowing access to gear chamber 126. Pinion opening 132 extends fully through mount plate 64. Pinion bore 134 is formed in retainer plate 54. Pinion bore 134 provides a space for receiving portions of rotational output assembly 22. In the example shown, pinion bore 134 extends partially through retainer plate 54, though it is understood that not all examples are so limited.

Pinion bearings 46*a*, 46*b* are supported by pump frame 44. Pinion bearings 46*a*, 46*b* are captured by pump frame 44. Pinion bearings 46*a*, 46*b* are captured by pump frame 44 such that pinion bearings 46*a*, 46*b* remain mounted to and supported by pump frame 44 even when rotational output assembly 22 is dismounted from pump frame 44.

Pinion bearing 46*a* is supported by pump frame 44. Pinion bearing 46*a* is at least partially disposed within pinion bore 134. Pinion bearing 46*a* is captured within pinion bore 134 such that pinion bearing 46*a* remains mounted to pump frame 44 while rotational output assembly 22 is dismounted from pump frame 44 and during mounting and dismounting of rotational output assembly 22 on pump frame 44. Pinion bearing 46*b* is supported by pump frame 44. Pinion bearing 46*b* is at least partially disposed within the pinion opening 132. Pinion bearing 46*b* is captured within pinion opening 132 such that pinion bearing 46*b* remains mounted to pump frame 44 when rotational output assembly 22 is dismounted from pump frame 44 and during mounting and dismounting of rotational output assembly 22 on pump frame 44.

Pinion bearing 46*a* is aligned with pinion bearing 46*b* on a pinion bearing axis PDA. The pinion bearing axis PDA is coaxial with the motor axis MA during mounting and dismounting of the rotational output assembly 22. Pinion drive 30 and portions of motor 28 of rotational output assembly 22 are shown. Rotor 70 is rotatably mounted to axle 116 at a first axial end of motor 28 by motor bearing 118*a*. Pinion drive 30 is connected to rotor 70 to receive a rotational output from rotor 70. Pinion drive 30 is configured to interface with pinion bearings 46*a*, 46*b* to form the dynamic connection between rotational output assembly 22 and pump frame 44. The dynamic interface structurally supports rotational output assembly 22 on pump frame 44 while facilitating transmission of the rotational output to drive assembly 24 by pinion drive 30. In the example shown, pinion drive 30 is the component of rotational output assembly 22 that forms the dynamic interface. As such, motor 28 does not directly interface with pump frame 44 at the dynamic interface.

In the example shown, the dynamic interface is breakable such that the rotational output assembly 22 can be mounted to and dismounted from pump frame 44. The dynamic interface is breakable by axial movement of the rotational output assembly 22 along the motor axis MA in second axial direction AD2. The breakable nature of the dynamic interface allows the same or different ones of the rotational output assembly 22 to be mounted to the same pump frame 44 and drive assembly 24.

In the example shown, the outer diameter BD2 pinion bearing 46*b* is larger than the outer diameter BD3 drive bearing 48*a*, the outer diameter BD3 drive bearing 48*a* is larger than the outer diameter BD4 of drive bearing 48*b*, and the outer diameter BD4 of drive bearing 48*b* is larger than the outer diameter BD1 of pinion bearing 46*a*. The crosswise positioning of the larger and smaller bearings supporting eccentric 92 and pinion drive 30 facilitates balancing of the pump loads generated by reciprocation of fluid displacer 36, reducing wear on the drive bearings 48*a*, 48*b* and pinion bearings 46*a*, 46*b* and providing for increased operational life.

An outer diameter BD1 of pinion bearing 46*a* is smaller than a minor diameter MD1 of the pinion cap 78 at gear teeth section 86. The minor diameter MD1 is taken at the base of the trench formed between adjacent ones of the pinion teeth 87 forming the gear teeth section 86. An outer diameter BD2 of pinion bearing 46*b* is larger than a major diameter MD2 of the pinion cap 78 at the pinion teeth of gear teeth section 86. The major diameter MD2 is taken at the tips of the teeth 87 forming gear teeth section 86. The relative sizing of the pinion bearings 46*a*, 46*b* and gear teeth section 86 facilitates mounting and dismounting of rotational output assembly 22 on pump frame 44 by axial movement along the motor axis MA.

The outer diameter OD1 of pinion end 84*a* is smaller than the outer diameter OD2 of pinion end 84*b*. The outer diameter OD1 of pinion end 84*a* is smaller than the minor diameter MD2 of the gear teeth section 86. The outer diameter OD2 of pinion end 84*b* is larger than the major diameter MD2 of the gear teeth section 86. The relative sizing of the pinion drive 30 facilitates the axial mounting of rotational output assembly 22. The outer diameter OD1 and major diameter MD2 are both smaller than outer diameter OD2 such that pinion end 84*a* and gear teeth section 86 can pass through pinion bearing 46*b* and pinion opening 132 without engaging with pinion bearing 46*b*.

During mounting, the rotational output assembly 22 is aligned with pinion bearings 46*a*, 46*b*. The motor axis MA is oriented coaxial with the pinion bearing axis PDA. Pump drive assembly 24 initially enters into pump frame 44 through pinion opening 132. Pump drive assembly 24 shifts axially through pinion opening 132 in the first axial direction AD1. Pinion end 84*a* passes through pinion bearing 46*b* and into gear chamber 126. Gear teeth section 86 passes through pinion bearing 46*b* and into gear chamber 126. Pinion end 84*a* and gear teeth section 86 can pass through the pinion bearing 46*b* by solely axial movement without contacting the pinion bearing 46*b*.

Rotational output assembly 22 continues to shift in the first axial direction AD1 such that pinion end 84*a* enters into engagement with pinion bearing 46*a*. Pinion end 84*a* passes into pinion bore 134 and engages with pinion bearing 46*a*. Gear teeth section 86 shifts into engagement with drive gear 94 to form the toothed interface 130 (best seen in FIG. 4B). The projecting teeth 109 of the drive gear 94 pass into the trenches formed between adjacent teeth of the pinion drive 30.

The teeth 109 of drive teeth section 108 have an axial length TL1 and the teeth 87 of gear teeth section 86 have a second axial length TL2. The axial length TL1 of the drive gear teeth 109 is shorter than axial length TL2 of the pinion drive teeth 87. The tooth length TL1 is taken along a portion of drive gear 94 in which the drive teeth 109 have a common height along their length. The tooth length TL2 is taken along a portion of pinion drive 30 in which the pinion teeth 87 have a common height along their length. The length TL2 is greater than the length TL1 such that the pinion teeth 87 are axially elongate relative to the drive teeth 109. The pinion teeth 87 and drive teeth 109 are axially elongate relative to the motor axis MA.

Gear teeth section 86 engages with drive teeth section 108 by an interface formed between the pinion teeth 87 and drive teeth 109. Pinion drive 30 continues to shift in first axial direction AD1 with gear teeth section 86 and drive teeth section 108 engaged. Pinion end 84*a* enters into and engages with pinion bearing 46*a*. The gear teeth section 86 continues to shift axially in first axial direction AD1 such that an axial end of the gear teeth section 86 passes beyond an axial end of the drive teeth section 108. The drive teeth section 108 thus fully radially overlaps with gear teeth section 86 relative to motor axis MA. The dynamic interface can thereby be formed by sliding axial engagement between the gear teeth section 86 of pinion drive 30 and drive teeth section 108 of drive gear 94.

The pinion drive 30 mounts such that the pinion teeth 87 forming gear teeth section 86 extends axially beyond drive teeth section 108 in both the first axial direction AD1 and second axial direction AD2. The toothed interface 130 is thus formed between pinion drive 30 and drive gear 94. Gear teeth section 86 engages with the full axial length of drive teeth section 108. The longer teeth of gear teeth section 86 facilitates alignment between gear teeth section 86 and drive teeth section 108 during mounting of rotational output assembly 22. The longer axial teeth of gear teeth section 86 balances the load transfer between pinion drive 30 and drive gear 94, providing a longer operational life and preventing wear on gear teeth section 86.

During mounting, pinion end 84*b* shifts in first axial direction AD1 and engages with pinion bearing 46*b* within pinion opening 132. Pinion end 84*b* engages with pinion bearing 46*b* such that pinion end 84*b* is supported on pump frame 44 by pinion bearing 46*b*. Rotational output assembly 22 is dynamically supported by pump frame 44 with pinion end 84*a* engaging pinion bearing 46*a* and pinion end 84*b* engaging pinion bearing 46*b*. Pinion bearings 46*a*, 46*b* are an only two bearings supporting the rotational output assembly 22 on the pump frame 44, in the example shown.

Pinion end 84*b* moving into engagement with pinion bearing 46*b* encloses gear chamber 126. Pinion end 84*b* engaging pinion bearing 46*b* encloses the openings through mount plate 64 and between an exterior of pump frame 44 and gear chamber 126.

In some examples, the brace plate 56 can be mounted on axle 116 prior to mounting rotational output assembly 22 to pump frame 44. Connectors 60 can be connected to brace plate 56 and project axially relative to brace plate 56 prior to mounting rotational output assembly 22 on pump frame 44. Mounting motor 28 can thus include passing pinion drive 30 into engagement with pinion bearings 46*a*, 46*b* to form the dynamic interface and connecting connectors 60 and brace plate 56 to support frame 52 to secure the static interface.

Rotational output assembly 22 is fully mechanically supported by pump frame 44 with the dynamic interface and static interface formed between the rotational output assembly 22 and the pump frame 44. With rotational output assembly 22 supported on pump frame 44, motor 28 can be connected to power and operated to cause pumping by pump 26. As discussed above, rotational output assembly 22 can be configured to rotate in either rotational direction on motor axis MA. Driving pump 26 by rotating rotor 70 in opposite rotational directions balances wear on the drive teeth 109 of drive teeth section 108 of drive gear 94 and on the pinion teeth 87 of the gear teeth section 86 of pinion drive 30. The teeth of drive gear 94 and pinion drive 30 can experience wear on both circumferential sides of each tooth, providing increased operational lifespan by distributing the wear.

Rotational output assembly 22 is dismountable from pump frame 44 by axial shifting of rotational output assembly 22 in second axial direction AD2. The static interface can be broken. For example, the static interface can be broken by disconnecting portions of pump frame 44 from other portions of pump frame 44. For example, brace plate 56 can be disconnected from base plate 62 and from connectors 60. In some examples, connectors 60 can be disconnected from mount plate 64. Rotational output assembly 22 is pulled in second axial direction AD2 off of pump frame 44 to disengage the toothed interface 130 and dismount rotational output assembly 22.

Pinion drive 30 is connected to rotor 70 such that pinion drive 30 moves axially with rotor 70 during both mounting and dismounting of rotational output assembly 22. During dismounting, pinion drive 30 moves with motor 28 such that pinion end 84*a* shifts out of engagement with pinion bearing 46*a*. Pinion drive 30 moves with motor 28 such that pinion end 84*b* shifts out of engagement with pinion bearing 46*b*. Pinion drive 30 moves with motor 28 such that gear teeth section 86 shifts axially in second axial direction AD2 relative to drive teeth section 108 while the toothed interface 130 is maintained. The pinion teeth 87 slide relative to the drive teeth 109. The toothed interface 130 can be sized such that the toothed interface 130 is maintained even with the interface between pinion bearing 46*a* and pinion end 84*a* broken and with the interface between pinion bearing 46*b* and pinion end 84*b* broken. The toothed interface 130 can be maintained with the dynamic bearing interfaces broken due to the axial length TL2 of the teeth of pinion drive 30. For example, the tooth length TL2 can be longer than an axial length AL1 of pinion end 84*a* and can be longer than an axial length AL2 of pinion end 84*b*.

During dismounting, rotational output assembly 22 is pulled in second axial direction AD2 such that gear teeth section 86 and pinion end 84*a* pass axially through pinion opening 132*b* and pinion bearing 46*b*. Pinion end 84*a* passes axially relative to drive gear 94 such that pinion end 84*a* radially overlaps with drive teeth section 108 during at least a portion of the mounting process and at least a portion of the dismounting process. Rotational output assembly 22 is pulled in second axial direction AD2 such that pinion drive 30 is removed from gear chamber 126 and disconnected from pump frame 44.

With rotational output assembly 22 dismounted from pump frame 44, the same or a different rotational output assembly 22 can be mounted to pump frame 44 to power drive assembly 24 and pumping by pump 26. For example, the first rotational output assembly 22 can be shifted in second axial direction AD2 to dismount the first rotational output assembly. A second rotational output assembly 22 can be shifted in first axial direction AD1 to mount the second rotational output assembly 22 to the pump frame 44. The second rotational output assembly 22 can be the same as or different from the first rotational output assembly 22.

Similar to rotational output assembly 22, drive assembly 24 can be mounted to and dismounted from pump frame 44. Drive assembly 24 can be mounted to and dismounted from pump frame 44 while rotational output assembly 22 remains mounted to pump frame 44. Retainer plate 54 can be disconnected from mount plate 64, such as by removing fasteners. Retainer plate 54, including the captured pinion bearing 46*a* and drive bearing 48*a*, can be pulled in first axial direction AD1 and off of support frame 52. Drive gear 94 and eccentric 92 move with retainer plate 54. An end of eccentric shaft 104 is pulled axially out of drive bearing 48*b* to disconnect from drive bearing 48*b*. Drive bearing 48*b* remains captured by mount plate 64 within drive bore 138. Drive assembly 24 is thus disconnected from support frame 52.

Drive assembly 24 can be mounted by shifting in second axial direction AD2 such that the end of eccentric shaft 104 shifts into and engages with drive bearing 48*b*. Pinion bearing 46*a* passes over pinion end 84*a* and engages with pinion end 84*a*. Retainer plate 54 is connected to mount plate 64 to enclose gear chamber 126. For example, retainer plate 54 can be connected to mount plate 64 by fasteners. Drive assembly 24 can thereby be dismounted to allow for mounting of a same or different drive assembly 24.

Fluid displacement assembly 20 provides significant advantages. Rotational output assembly 22 can be mounted to pump frame 44 and dismounted from pump frame 44 as a unitary assembly. Rotational output assembly 22 can be dismounted from pump frame 44 by solely axial movement of the rotational output assembly 22 relative to pump frame 44, along the motor axis MA. Similarly, rotational output assembly 22 can be mounted to pump frame 44 by solely axial movement of the rotational output assembly 22 relative to pump frame 44, along the motor axis MA. The mounting arrangement provides for simple and quick mounting of rotational output assembly 22 on pump frame 44. The mounting arrangement allows for rotational output assembly 22 go be quickly and easily removed for access and servicing or for replacement. The mounting arrangement decreases downtime, thereby reducing costs.

Pinion bearings 46*a*, 46*b* are captured by pump frame 44 such that pinion bearings 46*a*, 46*b* remain mounted on pump frame 44 when rotational output assembly 22 is dismounted. Pinion bearings 46*a*, 46*b* being captured on pump frame 44 reduces the part count as multiple different rotational output assemblies can be mounted to the same set of pinion bearings 46*a*, 46*b*. Pinion bearings 46*a*, 46*b* being captured by pump frame 44 protects pinion bearings 46*a*, 46*b* from contaminants. Pinion bearing 46*a* is fully within gear chamber 126 and pinion bearing 46*b* is disposed in pinion opening 132 such that pinion bearings 46*a*, 46*b* are shielded from contaminants, which pinion bearings 46*a*, 46*b* may otherwise be exposed to the contaminants if pinion bearings 46*a*, 46*b* are secured to pump drive assembly 24 to move with pump drive assembly 24.

The engagement between gear teeth section 86 and drive teeth section 108 formed and broken as a sliding interface during mounting and dismounting. The engagement can help align pinion drive 30 on pinion bearing axis PDA. The mounted and dismounted teeth 87 forming gear teeth section 86 are axially longer than the teeth 109 forming drive teeth section 108 that remain supported by pump frame 44 during mounting and dismounting of rotational output assembly 22. The axially longer teeth of the gear teeth section 86 facilitates alignment during mounting and provides balanced loading between drive gear 94 and pinion drive 30.

Figure 6A:
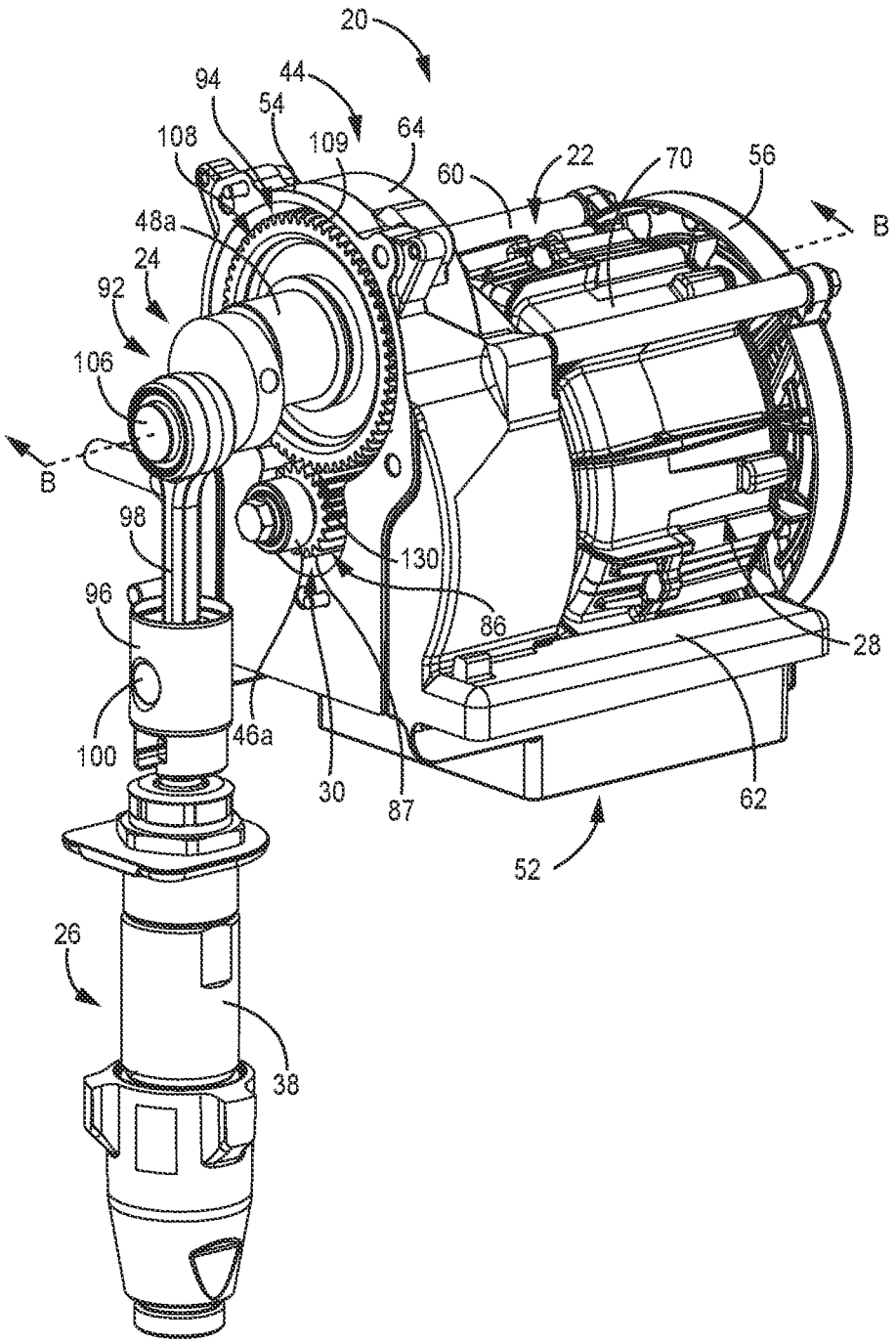
FIG. 6A is an isometric view of a fluid displacement assembly.
Figure 6B:
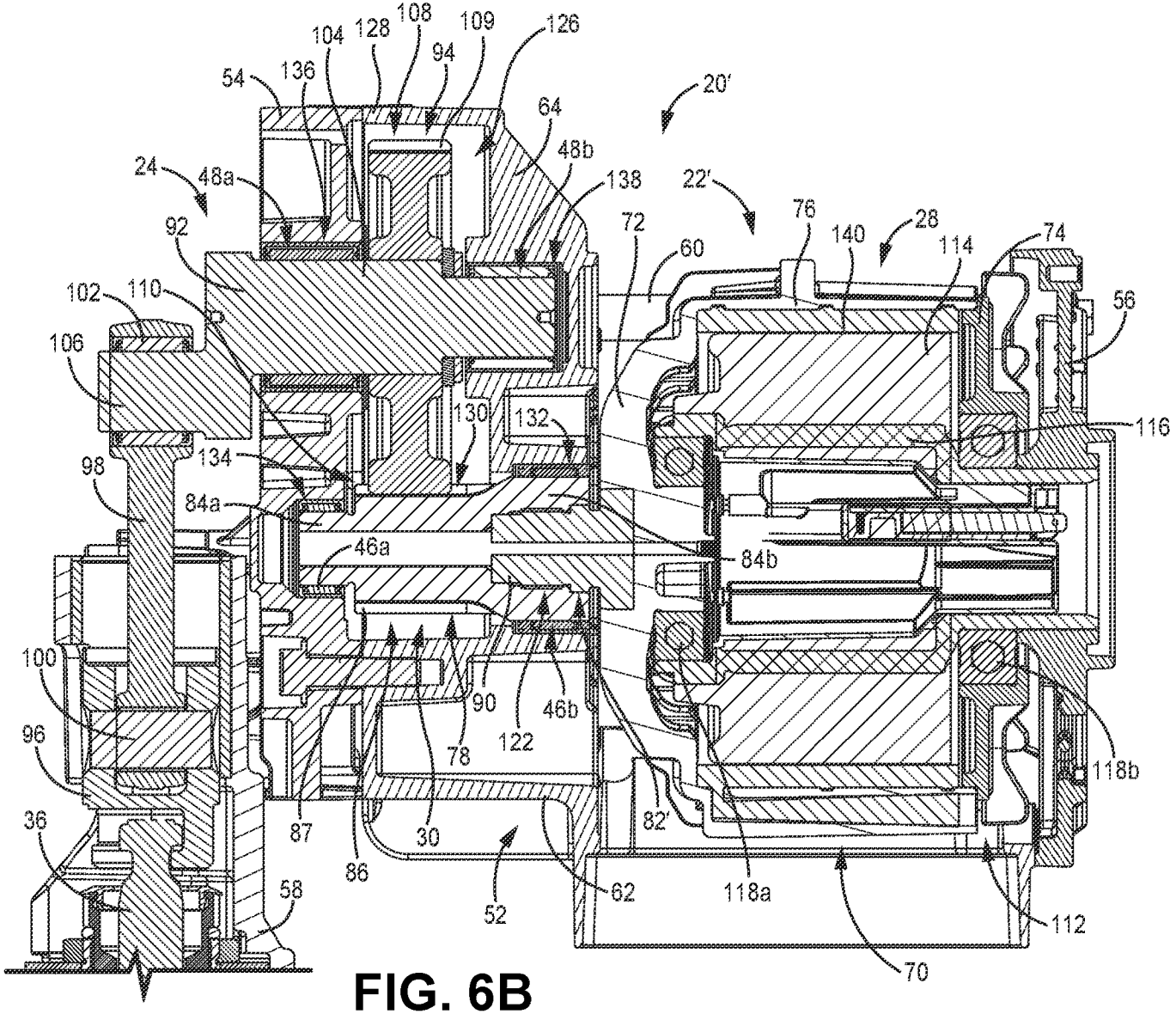
FIG. 6B is a cross-sectional view taken along line B-B in FIG. 6A.

FIG. 6A is an isometric view of fluid displacement assembly 20' with retainer plate 54 removed to expose portions of pinion drive 30 and drive assembly 24. FIG. 6B is an enlarged cross-sectional view along line B-B showing a portion of the dynamic interface between the pump frame 44 and rotational output assembly 22.

The fluid displacement assembly 20' shown in FIGS. 6A-6B is similar to the fluid displacement assembly 20 (FIGS. 2-5) previously shown and discussed. The examples are similar to each other and any detail referenced in connection with one example either is present in the other example or can be present in the other example. As such, all aspects between examples can be assumed to be the same unless shown and/or described to be clearly different such that the descriptions and drawings for one example are applicable to the other example. Various common aspects are not repeated between examples for brevity.

Components having the same reference numbers can be the same such that descriptions and/or drawings for one component can be imputed to another component, having the same reference number, of a different example. Likewise, components having the same name can be the same such that descriptions and/or drawings for one component can be imputed to another component, having the same name, of a different example.

In the example shown, pinion drive 30 is formed as a pinion cap 78 that is mounted to stud 82'. In the example shown, stud 82' is contiguous with the rest of the rotor housing (e.g., formed from the same piece of metal). For example, stud 82' can be formed integrally with first end wall 72 during casting of components of rotor 70, rather than being overcast during casting of rotor 70. In the example shown, first end wall 72 of rotor 70 includes a first projection extending in first axial direction AD1 and a second projection extending in second axial direction AD2. The first projection forms stud 82' that interfaces with pinion cap 78. The second projection forms a bearing surface that interfaces with an inner radial side of motor bearing 118*a*, relative to motor axis MA, to support rotor 70 on motor bearing 118*a*.

Pinion cap 78 is mounted on the stud 82' to form the pinion drive 30. In the example shown, pinion drive 30 does not include the fastener 80 extending through pinion drive 30 and interfacing with stud 82'. As such, the pinion cap 78 is mounted without the use of a bolt. In some examples, pinion cap 78 can be removably mounted to stud 82', such as by interfaced threading. In other examples, pinion cap 78 can be permanently connected to stud 82', such as by welding, adhesive, press-fitting etc. In some examples, the mounting bore 122 of pinion cap 78 can be contoured and the outer surface of stud 82' can be similarly contoured such that the mating interface between pinion cap 78 and stud 82' prevents relative rotation therebetween. While pinion cap 78 is shown as not mounted by a (e.g., fastener 80), it is understood that some examples of stud 82' include a threaded bore such that a fastener 80 can threadedly connected to stud 82' to further mount pinion cap 78 to stud 82'.

Figure 7:
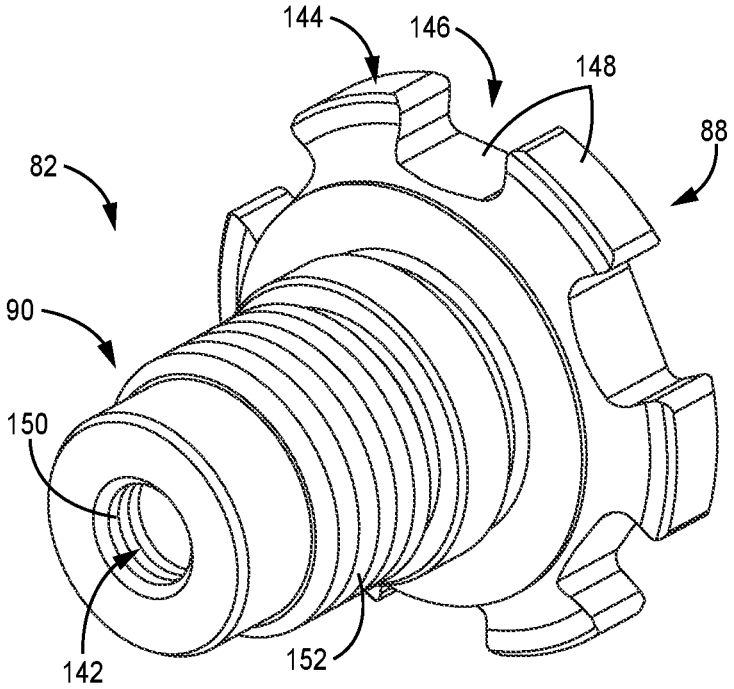
FIG. 7 is an isometric view of a stud.

FIG. 7 is an isometric view of stud 82. Stud 82 includes spline 88, post 90, and stud bore 124. Spline 88 is formed by projections 144 and notches 146 and includes outer radial surface 148. Post 90 extends axially from spline 88. Spline 88 is configured to interface with a portion of rotor 70 to connect stud 82 to rotor 70 for simultaneous rotation. The splined interface provides sufficient surface area between the first material forming rotor 70 and the second material forming stud 82 to facilitate rotor 70 transmitting torque without experiencing excessive loading. Stud 82 is formed from the more durable metal to facilitate stud 82 transmitting torque to pinion cap 78 by one or more interfaces having smaller interface contact surface area than the interface between stud 82 and rotor 70 when taken in a plane normal to the motor axis MA.

The outer radial surface 148 of spline 88 varies in distance from the motor axis MA circumferentially about spline 88 due to projections 144 and notches 146. Projections 144 extend radially away from a base of spline 88. Projections 144 increase the area of the outer radial surface 148 to facilitate torque transfer. Notches 146 are formed between adjacent ones of the projections 144. The material forming rotor 70 is cast into notches 146 to form a tight mechanical fit between stud 82 and rotor 70. Post 90 extends axially outward from spline 88 away from rotor 70. Post 90 is not overcast by the material forming rotor 70. The durable material forming stud 82 is exposed along post 90.

Stud bore 124 extends into post 90. Stud bore 124 includes fastener threads 150 within the stud bore 124. The fastener threads 150 are configured to mate with the threads on fastener 80 at a threaded interface to connect fastener 80 and stud 82. Cap threads 152 are formed on an exterior of post 90. Cap threads 152 are configured to mate with threads on pinion cap 78 to connect pinion cap 78 and stud 82. Cap threads 152 and fastener threads 150 can be oriented in opposite directions about the stud 82 to form a dual directional threaded interface.

Stud 82 facilitates torque transfer from the motor 28 to pinion cap 78 to power pumping by a pump. Stud 82 being formed from a more reliant material than the body of the rotor, decreasing weight and costs as compared to casting rotor 70 from the material forming stud 82. Spline 88 provides increased surface area relative to a smooth outer radial surface 148 and defines notches 146 to capture the cast material, providing a strong mounting interface between stud 82 and rotor 70. The dual directional threaded interface of the stud 82 facilitates mounting and retention of the pinion cap 78 and prevents loosening if rotor 70 reverses rotational direction.

Discussion of Non-Exclusive Examples

The following are non-exclusive descriptions of possible examples of the present invention(s).

A fluid pumping assembly includes an electric motor having a stator and a rotor comprising a rotor housing and configured to rotate on a motor axis; a pinion cap formed separate from and attached to the rotor housing, the pinion cap comprising a gear teeth section; a drive gear that interfaces with the gear teeth section at a toothed interface; an eccentric that receives rotational motion from the drive gear; and a pump that receives reciprocating motion from the eccentric.

The fluid pumping assembly of the preceding paragraph can optionally include, additionally and/or alternatively, any one or more of the following features, configurations and/or additional components:

The rotor rotates about the stator.

The pinion cap does not radially overlap with the stator.

The pinion cap does not radially overlap with any magnets of the rotor.

The pinion cap is located entirely outside of the motor.

No rod extends entirely axially through the motor.

The pinion cap includes a first pinion end that interfaces with a first pinion bearing and a second pinion end that interfaces with a second pinion bearing, and wherein the gear teeth section is located between the first pinion end and the second pinion end.

The eccentric includes an eccentric shaft on which the drive gear is mounted, the eccentric shaft supported by a first eccentric bearing and a second eccentric bearing.

The first eccentric bearing radially overlaps with the first pinion bearing and the second eccentric bearing radially overlaps with the second pinion bearing.

The second pinion bearing is larger than the first eccentric bearing, the first eccentric bearing is larger than the second eccentric bearing, and the second eccentric bearing is larger than the first pinion bearing.

The second pinion bearing is disposed axially between the gear teeth section and the rotor housing.

The first eccentric bearing is disposed on an opposite axial side of the toothed interface from the second pinion bearing, and wherein the second eccentric bearing is disposed on an opposite axial side of the toothed interface from the first pinion bearing.

A stud on which the pinion cap is mounted, the stud extending away from the rotor housing.

The stud includes a spline interfacing with the rotor housing and a post extending axially from the spline and away from the rotor housing.

A fastener extending through the pinion cap and connected to the stud by a first threaded interface between the fastener and the stud.

The pinion cap is mounted on the stud by a second threaded interface between the pinion cap and the stud.

The first threaded interface has a first thread direction, the second threaded interface has a second thread direction, and the first thread direction differs from the second thread direction.

A bolt that extends through the pinion cap to fix the pinion cap with respect to the rotor housing.

A stud on which the pinion cap is mounted, the stud extending away from the rotor housing. The bolt extends into the stud and radially overlaps with the stud and the pinion cap.

The pinion cap is fixed relative to the rotor by a first threaded interface and the fastener is fixed relative to the rotor by a second threaded interface.

A thread direction is reversed between the first threaded interface and the second threaded interface.

The rotor housing includes an open end that faces away from the pump and a closed end that faces toward the pump.

The pinion cap is mounted to the closed end of the rotor housing.

A hose and gun for spraying of pumped fluid.

The pump is a piston pump.

A fluid pumping assembly includes an electric motor configured to generate a rotational output, the electric motor having a stator and a rotor comprising a rotor housing and configured to rotate on a motor axis, the rotor including a first end wall, a second end wall, and a rotor body therebetween; a stud projecting from the first end wall, the stud projecting in a first axial direction along the motor axis and away from the stator; a pinion cap formed separate from and attached to the rotor, the pinion cap mounted on the stud, the pinion cap including a gear teeth section; a drive interfacing the pinion cap at a toothed interface to receive the rotational output from the electric motor via the pinion cap, the drive configured to convert the rotational output into reciprocating motion; and a pump that receives reciprocating motion from the drive.

The fluid pumping assembly of the preceding paragraph can optionally include, additionally and/or alternatively, any one or more of the following features, configurations and/or additional components:

The stud is formed separately from and connected to the rotor.

The stud does not extend fully through the first end wall.

The stud does not extend into any motor bearing supporting the rotor relative to the stator.

The stud includes first threading formed in a bore of the stud and second threading formed on an exterior of the stud.

The first threading and the second threading radially overlap.

The stud includes a post projecting axially away from the stator, the first threading is formed within the post and the second threading is formed on an exterior of the post.

The first threading has a first thread direction, the second threading has a second thread direction, and the first thread direction is opposite the second thread direction.

A pump frame, the electric motor supported on the pump frame by a static interface between the pump frame and the electric motor, and the electric motor supported on the pump frame by a dynamic interface between the pump frame and the pinion drive.

The pinion drive is mounted to the pump frame by a first pinion bearing and by a second pinion bearing, the gear teeth section disposed between the first pinion bearing and the second pinion bearing.

The first pinion bearing is supported by a first plate of the pump frame, the second pinion bearing is supported by a second plate of the pump frame, the first plate separate from and connected to the second plate.

The drive includes a drive gear connected to the pinion drive at the toothed interface; and an eccentric connected to the drive gear to rotate with the drive gear, the eccentric connected to the pump to drive reciprocation of a fluid displacer of the pump.

A rotational output assembly configured to power pumping by a pump via a drive, the rotational output assembly including an electric motor having a stator and a rotor comprising a rotor housing and configured to rotate on a motor axis, the rotor including a first end wall, a second end wall, and a rotor body therebetween; a stud projecting from the first end wall, the stud projecting in a first axial direction along the motor axis and away from the stator; and a pinion cap formed separate from and attached to the rotor, the pinion cap mounted on the stud, the pinion cap including a gear teeth section between a first pinion end of the pinion cap and a second pinion end of the pinion cap, the second pinion end disposed between the gear teeth section and the rotor.

The rotational output assembly of the preceding paragraph can optionally include, additionally and/or alternatively, any one or more of the following features, configurations and/or additional components:

The rotor rotates about the stator.

The second end wall includes an opening, and wherein an axle of the motor extends through the second end wall.

The rotor is supported on the axle by motor bearings.

The pinion cap is mounted on the stud by a threaded interface.

The pinion cap is connected to the stud by a fastener engaging the stud.

The pinion cap is mounted to an exterior of the stud by a first threaded interface; a fastener extends through the pinion cap and engages the stud at a second threaded interface; and the first threaded interface has a first thread direction and the second threaded interface has a second thread direction opposite the first thread direction.

The first threaded interface radially overlaps with the second threaded interface.

The stud includes a spline interfacing with the first end wall and includes a post extending axially from the spline and away from the rotor.

A fluid pumping assembly includes an electric motor having a stator and a rotor comprising a rotor housing and configured to rotate on a motor axis; a pinion drive extending axially from the rotor housing and including a first pinion end, a second pinion end, and a gear teeth section disposed between the first pinion end and the second pinion end; a first pinion bearing interfacing with the first pinion end; a second pinion bearing interfacing with the second pinion end; a drive gear that interfaces with the gear teeth section at a toothed interface; an eccentric that receives rotational motion from the drive gear; and a pump that receives reciprocating motion from the eccentric.

The fluid pumping assembly of the preceding paragraph can optionally include, additionally and/or alternatively, any one or more of the following features, configurations and/or additional components:

A support frame and a retainer plate connected to the support frame; wherein the first pinion bearing interfaces with the retainer plate and the second pinion bearing interfaces with the support frame.

The support frame and the retainer plate define a gear chamber, the toothed interface disposed in the gear chamber.

The pinion drive extends through an opening in the support frame such that the support frame is disposed between the gear tooth section and the rotor.

The second pinion bearing is at least partially disposed in the opening.

The first pinion end extends into a bore in the retainer plate.

The first pinion bearing is at least partially disposed in the bore.

The bore includes a closed axial end.

The second pinion end is disposed between the gear tooth section and the rotor body, and wherein the second pinion bearing is larger than the first pinion bearing.

The eccentric includes an eccentric shaft on which the drive gear is mounted, the eccentric shaft supported by a first eccentric bearing and a second eccentric bearing.

The first eccentric bearing radially overlaps with the first pinion bearing and the second eccentric bearing radially overlaps with the second pinion bearing.

The second pinion bearing is larger than the first eccentric bearing, the first eccentric bearing is larger than the second eccentric bearing, and the second eccentric bearing is larger than the first pinion bearing.

The first eccentric bearing is disposed on an opposite axial side of the toothed interface from the second pinion bearing, and wherein the second eccentric bearing is disposed on an opposite axial side of the toothed interface from the first pinion bearing.

A diameter of the first pinion end is smaller than a minor diameter of the gear tooth section.

An outer diameter of the first pinion bearing is smaller than a minor diameter of the gear tooth section.

A diameter of the second pinion end is larger than a major diameter of the gear tooth section.

An outer diameter of the second pinion bearing is larger than a major diameter of the gear tooth section.

The pinion drive includes a pinion cap formed separately from and connected to the rotor body.

The first pinion bearing is a needle type bearing.

The second pinion bearing is a needle type bearing.

The pinion drive does not include a rod that extends into the motor.

The motor includes a first motor bearing and a second motor bearing rotatably supporting the rotor and disposed within the motor.

The rotor rotates about the stator, the first motor bearing is disposed within the rotor housing, and the second motor bearing is disposed within the rotor housing.

A fluid pumping assembly includes a pump frame; a motor supported by the pump frame and having a rotor and a stator, the rotor supported relative to the stator by at least one motor bearing disposed within the motor such that the rotor rotates on a motor axis; a pinion drive extending axially from a first end of the rotor, a drive gear interfacing with the pinion drive at a toothed interface between the drive gear and a gear teeth section; and an eccentric connected to the drive gear to be rotated by the drive gear. The pinion drive includes a first pinion end interfacing with a first pinion bearing supported by the pump frame; a second pinion end interfacing with a second pinion bearing supported by the pump frame; and the gear teeth section disposed axially between the first pinion end and the second pinion end.

The fluid pumping assembly of the preceding paragraph can optionally include, additionally and/or alternatively, any one or more of the following features, configurations and/or additional components:

The first pinion end has a first outer diameter, the second pinion end has a second outer diameter, and the first outer diameter is smaller than the second outer diameter.

A minor diameter of the gear teeth section is larger than the first outer diameter.

A major diameter of the gear teeth section is smaller than the second outer diameter.

The second pinion end is disposed between the gear teeth section and the stator.

The gear teeth section includes a plurality of axially elongate teeth.

A first pinion bearing interfacing with the pump frame and the first pinion end to support the first pinion end; and a second pinion bearing interfacing with the pump frame and the second pinion end to support the second pinion end.

A first drive bearing interfacing with the pump frame and the eccentric to support the eccentric; and a second drive bearing interfacing with the pump frame and the eccentric to support the eccentric.

The first drive bearing radially overlaps with the first pinion bearing, and the second drive bearing radially overlaps with the second pinion bearing.

The first pinion bearing is smaller than the second drive bearing, the second drive bearing is smaller than the first drive bearing, and the first drive bearing is smaller than the second pinion bearing.

A fluid pumping assembly includes a pump frame at least partially defining a gear chamber; a drive gear supported by the pump frame; an eccentric that receives rotational motion from the drive gear; a first pinion bearing captured by the pump frame; a second pinion bearing captured by the pump frame; and a rotational output assembly. The rotational output assembly includes an electric motor having a stator and a rotor comprising a rotor housing and configured to rotate on a motor axis; and a pinion drive extending axially from the rotor housing and including a first pinion end, a second pinion end, and a gear teeth section disposed between the first pinion end and the second pinion end, the gear teeth section configured to interface with the drive gear at a toothed interface disposed at least partially within the gear chamber. The rotational output assembly is mountable to the pump frame by movement of the rotational output assembly in a first axial direction along the motor axis, and the rotational output assembly dismountable from the pump frame by movement of the rotational output assembly in a second axial direction opposite the first axial direction.

The fluid pumping assembly of the preceding paragraph can optionally include, additionally and/or alternatively, any one or more of the following features, configurations and/or additional components:

The pinion drive is disconnectable from the first pinion bearing and the second pinion bearing by relative axial movement such that the first pinion bearing and the second pinion bearing remain mounted on the pump frame with the rotational output assembly dismounted from the pump frame.

The first bearing is smaller than the second bearing.

A first diameter of the first pinion end is smaller than a tooth diameter of the gear tooth section, and the tooth diameter is smaller than a second diameter of the second pinion end.

The tooth diameter is a minor tooth diameter.

The tooth diameter is a major tooth diameter.

The eccentric is mounted on a first drive bearing and a second drive bearing.

The first drive bearing and the second drive bearing are larger than the first pinion bearing.

The first drive bearing and the second drive bearing are smaller than the second pinion bearing.

The first pinion bearing is supported by a first plate of the pump frame and the second pinion bearing is supported by a second plate of the pump frame.

The first pinion bearing is disposed in a bearing chamber formed in the first plate and the second pinion bearing is disposed in a bore through the second plate.

The second pinion bearing is sized such that the first pinion end and the gear tooth section can pass by solely axial movement through the second pinion bearing without contacting the second pinion bearing.

The first plate is fixed to the second plate by fasteners.

The first plate includes a drive bore through which the eccentric fully extends, and wherein the second plate includes a drive bearing chamber extending partially through the second plate and into which the eccentric extends.

The first pinion bearing is a needle bearing and the second pinion bearing is a needle bearing.

A modular pumping assembly includes a pump frame configured to support a displacement pump; a first pinion bearing captured by the pump frame; a second pinion bearing aligned with the first pinion bearing on a pinion support axis, the second pinion bearing captured by the pump frame; and a first rotational output assembly. The first rotational output assembly includes a first electric motor having a first stator and a first rotor comprising a first rotor housing and configured to rotate on a first motor axis; and a first pinion drive extending axially from the first rotor housing and including a first pinion end, a second pinion end, and a first gear teeth section disposed between the first pinion end and the second pinion end, the first gear teeth section configured to output rotational motion from the first rotor at a first toothed interface. The first rotational output assembly is mountable to the pump frame by movement of the first rotational output assembly in a first axial direction along the pinion support axis with the first motor axis disposed coaxial with the pinion support axis. The first rotational output assembly is dismountable from the pump frame by movement of the first rotational output assembly in a second axial direction opposite the first axial direction.

The modular pumping assembly of the preceding paragraph can optionally include, additionally and/or alternatively, any one or more of the following features, configurations and/or additional components:

A second rotational output assembly including a second electric motor having a second stator and a second rotor comprising a second rotor housing and configured to rotate on a second motor axis; and a second pinion drive extending axially from the second rotor housing and including a third pinion end, a fourth pinion end, and a second gear teeth section disposed between the third pinion end and the fourth pinion end, the second gear teeth section configured to output rotational motion from the second rotor at a second toothed interface. The second rotational output assembly is mountable to the pump frame by movement of the second rotational output assembly in the first axial direction along the pinion support axis with the second motor axis disposed coaxial with the pinion support axis. The second rotational output assembly is dismountable from the pump frame by movement of the second rotational output assembly in the second axial direction opposite the first axial direction.

The pump frame includes a pinion opening between an exterior of the pump frame and a gear chamber within the pump frame and a pinion bore formed in the pump frame and disposed on an opposite side of the gear chamber from the pinion opening along the pinion axis.

The pump frame is formed from a first plate fastened to a second plate, the pinion bore formed in the first plate and the pinion opening formed in the second plate.

The first rotor is disposed on an opposite side of the second plate from the gear chamber.

The second plate is integrally formed with a base plate that extends to radially overlap with the first rotor with the first rotational output assembly mounted to the pump frame.

A drive gear supported by a shaft, the shaft supported by a first drive bearing supported by the first plate and a second drive bearing supported by the second plate; a drive opening extends fully through the first plate, the first drive bearing mounted in the drive opening; and a drive bore extending into the second plate, the second drive bearing mounted in the drive bore. The first toothed interface is formed between the gear tooth section and the drive gear.

The gear tooth section includes a plurality of pinion teeth, each pinion tooth axially elongate relative to the first motor axis.

The toothed interface is formed by sliding axial engagement between drive gear teeth of the drive gear and the plurality of pinion teeth as the first rotational output assembly is mounted to the pump frame.

The first pinion bearing and the second pinion bearing are an only two bearings supporting the first rotational output assembly on the pump frame.

A diameter of the first pinion end is smaller than a minor diameter of the gear tooth section.

A diameter of the second pinion end is larger than a major diameter of the gear tooth section.

A method of mounting a rotational output generator to a pumping assembly includes aligning a first rotational output assembly with a pump frame such that a rotational axis of the motor is aligned coaxially with a pinion bearing axis through the pump frame; and shifting the first rotational output assembly axially relative to the pinion axis and in a first axial direction to form a dynamic mechanical connection between the rotational output assembly and the pump frame, the first rotational output assembly configured to power pumping by a pump supported by the pump frame.

The method of the preceding paragraph can optionally include, additionally and/or alternatively, any one or more of the following features, configurations and/or additional components:

Shifting the first rotational output assembly such that a pinion drive extending axially from a rotor of an electric motor of the first rotational output assembly passes into engagement with pinion bearings supported by the pump frame, the pinion bearings including a first pinion bearing and a second pinion bearing.

Shifting the first rotational output assembly in the first axial direction such that a first pinion end of the pinion drive and a gear teeth section of the pinion drive pass through the second pinion bearing prior to a second pinion end of the pinion drive engaging the second pinion bearing to rotatably support the pinion drive by the second pinion bearing.

Enclosing a toothed interface between the pinion drive and a drive gear by engaging the second pinion end with the second pinion bearing, the drive gear supported by the pump frame within a gear chamber defined by the pump frame.

Forming a toothed interface between the first rotational output assembly and a drive gear rotatably supported by the pump frame by pinion teeth of the first rotational output assembly sliding axially relative to drive gear teeth of the drive gear along the pinion bearing axis.

Forming a static mechanical connection between the first rotational output assembly and the pump frame.

Forming the static mechanical connection at a second axial end of the electric motor, the pinion drive projecting from a first axial end of the electric motor opposite the second axial end of the electric motor.

Dismounting the first rotational output assembly from the pump frame by shifting the first rotational output assembly in a second axial direction opposite the first axial direction.

Mounting a second rotational output assembly to the pump frame by shifting the second rotational output assembly in the first axial direction to form a second dynamic mechanical connection between the second rotational output assembly and the pump frame, the second rotational output assembly configured to power pumping by the pump.

While the invention(s) has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention(s) without departing from the essential scope thereof. Therefore, it is intended that the invention(s) not be limited to the particular embodiment(s) disclosed, but that the invention(s) may include all embodiments falling within the scope of the appended claims. Any single feature, or any combination of features from one embodiment show herein, may be utilized in a different embodiment independent from the other features shown in the embodiment herein. Accordingly, the scope of the invention(s) and any claims thereto are not limited to the particular to the embodiments and/or combinations of the features shown herein, but rather can include any combination of one, two, or more features shown herein.

The invention claimed is:

1. A fluid pumping assembly comprising:

a rotational output assembly comprising:
- an electric motor comprising:
  - a stator; and
  - a rotor comprising a rotor housing and configured to rotate on a motor axis; and
- a pinion cap formed separate from and attached to the rotor housing, the pinion cap comprising a gear teeth section;

a drive gear that interfaces with the gear teeth section at a toothed interface;

an eccentric that receives rotational motion from the drive gear;;

a pump that receives reciprocating motion from the eccentric;

an eccentric shaft on which the drive gear is mounted;

a first drive bearing radially overlapping with the first pinion bearing, disposed on an opposite axial side of the toothed interface from the second pinion bearing, and supporting the eccentric shaft; and a second drive bearing radially overlapping with the second pinion bearing, disposed on an opposite axial side of the toothed interface from the first pinion bearing, and supporting the eccentric shaft;

wherein the second pinion bearing is larger than the first drive bearing, the first drive bearing is larger than the second drive bearing, and the second drive bearing is larger than the first pinion bearing.

2. A fluid pumping assembly comprising:

a rotational output assembly comprising:
- an electric motor comprising:
  - a stator; and
  - a rotor comprising a rotor housing and configured to rotate on a motor axis;
- a pinion cap formed separate from and attached to the rotor housing, the pinion cap comprising a gear teeth section;
- a stud on which the pinion cap is mounted, the stud extending away from the rotor housing; and
- a fastener extending through the pinion cap and connected to the stud by a first threaded interface between the fastener and the stud;

a drive gear that interfaces with the gear teeth section at a toothed interface;

an eccentric that receives rotational motion from the drive gear; and a pump that receives reciprocating motion from the eccentric;

wherein the pinion cap is mounted on the stud by a second threaded interface between the pinion cap and the stud, and wherein the first threaded interface has a first thread direction, the second threaded interface has a second thread direction, and the first thread direction differs from the second thread direction.

3. A fluid pumping assembly comprising:

a rotational output assembly comprising:
- an electric motor comprising:
  - a stator; and
  - a rotor comprising a rotor housing and configured to rotate on a motor axis;
- a pinion cap formed separate from and attached to the rotor housing, the pinion cap comprising a gear teeth section;
- a stud on which the pinion cap is mounted, the stud extending away from the rotor housing; and
- a fastener extending through the pinion cap and connected to the stud by a first threaded interface between the fastener and the stud;

a drive gear that interfaces with the gear teeth section at a toothed interface;

an eccentric that receives rotational motion from the drive gear; and a pump that receives reciprocating motion from the eccentric;

wherein the pinion cap is fixed relative to the rotor by a first threaded interface and the fastener is fixed relative to the rotor by a second threaded interface, and wherein a thread direction is reversed between the first threaded interface and the second threaded interface.

4. A fluid pumping assembly comprising:

a pump frame;

a rotational output assembly supported by the pump frame, the rotational output assembly comprising:
- an electric motor comprising:
  - a stator; and
  - a rotor comprising a rotor housing and configured to rotate on a motor axis; and
- a pinion drive extending axially from the rotor housing, the pinion drive comprising:
  - a first pinion end;
  - a second pinion end; and
  - a gear teeth section disposed axially between the first pinion end and the second pinion end relative to the motor axis, the first pinion end extending axially outward from the gear teeth section and the second pinion end extending axially outward from the gear teeth section;

a first pinion bearing interfacing with the first pinion end and the pump frame, the first pinion bearing engaged with the first pinion end with the rotational output assembly supported by the pump frame;

a second pinion bearing interfacing with the second pinion end and the pump frame, the second pinion bearing engaged with the second pinion end with the rotational output assembly supported by the pump frame;

a drive gear that interfaces with the gear teeth section at a toothed interface;

an eccentric that receives rotational motion from the drive gear; and a pump that receives reciprocating motion from the eccentric, the pump connected to the pump frame to be supported by the pump frame;

wherein the pinion drive is disposed between an interface connecting the pump to the pump frame and the eccentric, and wherein the pinion drive is disposed between the electric motor and a follower connecting the eccentric to a piston of the pump;

wherein a diameter the first pinion end is smaller than a minor diameter of the gear tooth section and a diameter of the second pinion end is larger than a major diameter of the gear tooth section.

5. The fluid pumping assembly of claim 4, wherein the rotor includes a plurality of magnets, and the pinion drive does not radially overlap with any magnet of the plurality of magnets of the rotor.

6. The fluid pumping assembly of claim 4, wherein no rod extends entirely axially through the motor.

7. The fluid pumping assembly of claim 4, further comprising:

a support frame having a mount plate; and a retainer plate connected to the support frame;

wherein the first pinion bearing interfaces with the retainer plate and the second pinion bearing interfaces with the mount plate.

8. The fluid pumping assembly of claim 7, wherein the mount plate and the retainer plate define a gear chamber, the toothed interface disposed in the gear chamber.

9. The fluid pumping assembly of claim 4, wherein:

the gear tooth section is disposed between the first pinion end and the rotor housing.

10. The fluid pumping assembly of claim 4, wherein:

the pinion drive is formed as a pinion cap formed separate from and attached to the rotor housing, the pinion cap comprising the gear teeth section.

11. The fluid pumping assembly of claim 10, wherein the second pinion bearing and the second pinion end are disposed axially between the gear teeth section and the rotor housing.

12. The fluid pumping assembly of claim 10, further comprising:

a stud on which the pinion cap is mounted, the stud extending away from the rotor housing.

13. The fluid pumping assembly of claim 12, wherein the stud includes a spline interfacing with the rotor housing and a post extending axially from the spline and away from the rotor housing.

14. The fluid pumping assembly of claim 12, further comprising:

a fastener extending through the pinion cap and connected to the stud by a first threaded interface between the fastener and the stud.

15. The fluid pumping assembly of claim 14, wherein the fastener radially overlaps with the stud and the pinion cap and does not radially overlap with support bearings within the rotor.

16. A fluid pumping assembly comprising:

a pump frame;

a rotational output assembly supported by the pump frame, the rotational output assembly comprising:

an electric motor comprising:

a stator; and a rotor comprising a rotor housing and configured to rotate on a motor axis; and a pinion drive extending axially from the rotor housing, the pinion drive comprising:

a first pinion end;

a second pinion end; and a gear teeth section disposed axially between the first pinion end and the second pinion end relative to the motor axis;

a first pinion bearing interfacing with the first pinion end and the pump frame;

a second pinion bearing interfacing with the second pinion end and the pump frame;

a drive gear that interfaces with the gear teeth section at a toothed interface;

an eccentric that receives rotational motion from the drive gear; and a pump that receives reciprocating motion from the eccentric;

wherein:

the pinion drive extends through an opening in the pump frame such that the pump frame is disposed between the gear tooth section and the rotor;

the second pinion bearing is at least partially disposed in the opening;

the first pinion end extends into a bore in the retainer plate;

the first pinion bearing is at least partially disposed in the bore;

the second pinion end is disposed between the gear tooth section and the rotor housing; and the second pinion bearing is larger than the first pinion bearing.

17. A fluid pumping assembly comprising:

a pump frame at least partially defining a gear chamber;

a drive gear supported by the pump frame;

an eccentric that receives rotational motion from the drive gear;

a first pinion bearing captured by the pump frame;

a second pinion bearing captured by the pump frame;

a rotational output assembly comprising:

an electric motor comprising:

a stator; and a rotor comprising a rotor housing and configured to rotate on a motor axis; and a pinion drive extending axially from the rotor housing and including a first pinion end, a second pinion end, and a gear teeth section disposed between the first pinion end and the second pinion end, the gear teeth section configured to interface with the drive gear at a toothed interface disposed at least partially within the gear chamber;

wherein the rotational output assembly is mountable to the pump frame by movement of the rotational output assembly in a first axial direction along the motor axis such that the first pinion end is engaged with the first pinion bearing and the second pinion end is engaged with the second pinion bearing with the rotational output assembly mounted to the pump frame, and wherein the rotational output assembly is dismountable from the pump frame by movement of the rotational output assembly in a second axial direction opposite the first axial direction, such that the first pinion end is disengaged from the first pinion bearing and the second pinion end is disengaged from the second pinion bearing with the rotational output assembly dismounted from the pump frame.

18. The fluid pumping assembly of claim 17, wherein the pinion drive is disconnectable from the first pinion bearing and the second pinion bearing by relative axial movement such that the first pinion bearing and the second pinion bearing remain mounted on the pump frame with the rotational output assembly dismounted from the pump frame.

19. A fluid pumping assembly comprising:

a pump frame at least partially defining a gear chamber;

a drive gear supported by the pump frame;

an eccentric that receives rotational motion from the drive gear;

a first pinion bearing captured by the pump frame;

a second pinion bearing captured by the pump frame;

a rotational output assembly comprising:

an electric motor comprising:

a stator; and a rotor comprising a rotor housing and configured to rotate on a motor axis; and a pinion drive extending axially from the rotor housing and including a first pinion end, a second pinion end, and a gear teeth section disposed between the first pinion end and the second pinion end, the gear teeth section configured to interface with the drive gear at a toothed interface disposed at least partially within the gear chamber;

the rotational output assembly mountable to the pump frame by movement of the rotational output assembly in a first axial direction along the motor axis, and the rotational output assembly dismountable from the pump frame by movement of the rotational output assembly in a second axial direction opposite the first axial direction;

wherein:

the first pinion bearing is supported by a first plate of the pump frame and the second pinion bearing is supported by a second plate of the pump frame;

the first pinion bearing is disposed in a bore formed in the first plate and the second pinion bearing is disposed in an opening through the second plate; and the second pinion bearing is sized such that the first pinion end and the gear tooth section can pass through the second pinion bearing by solely axial movement without contacting the second pinion bearing.

* * * * *